US009983511B2

(12) United States Patent
Sakamaki

(10) Patent No.: US 9,983,511 B2
(45) Date of Patent: May 29, 2018

(54) IMAGE FORMING APPARATUS HAVING REVERSE DEVELOPER FEEDING

(71) Applicant: CANON KABUSHIKI KAISHA, Tokyo (JP)

(72) Inventor: Tomoyuki Sakamaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/298,402

(22) Filed: Oct. 20, 2016

(65) Prior Publication Data

US 2017/0115606 A1 Apr. 27, 2017

(30) Foreign Application Priority Data

Oct. 27, 2015 (JP) ..... 2015-210299

(51) Int. Cl.
*G03G 15/08* (2006.01)

(52) U.S. Cl.
CPC ..... *G03G 15/0891* (2013.01); *G03G 15/0865* (2013.01); *G03G 15/0893* (2013.01); *G03G 15/0841* (2013.01); *G03G 15/0843* (2013.01); *G03G 15/0844* (2013.01); *G03G 15/0881* (2013.01); *G03G 15/0882* (2013.01); *G03G 15/0884* (2013.01); *G03G 15/0887* (2013.01); *G03G 15/0889* (2013.01)

(58) Field of Classification Search
CPC ..... G03G 2215/088; G03G 2215/0877; G03G 2215/0687; G03G 2215/00991; G03G 2215/00987
See application file for complete search history.

(56) References Cited

U.S. PATENT DOCUMENTS

| | | | | |
|---|---|---|---|---|
| 8,131,187 | B2 | 3/2012 | Uno | |
| 8,355,655 | B2 | 1/2013 | Sakamaki | |
| 8,855,525 | B2 | 10/2014 | Muto et al. | |
| 2015/0037071 | A1* | 2/2015 | Yamamoto | G03G 15/0879 399/258 |

(Continued)

FOREIGN PATENT DOCUMENTS

| | | | |
|---|---|---|---|
| JP | S59-100471 | A | 6/1984 |
| JP | H11-038740 | A | 2/1999 |

(Continued)

*Primary Examiner* — Joseph S Wong
(74) *Attorney, Agent, or Firm* — Fitzpatrick, Cella, Harper & Scinto

(57) ABSTRACT

A developing apparatus for developing an electrostatic latent image formed on an image bearing member includes a developer carrying member, first and second accommodation chambers to accommodate developer, and a feeding screw provided in the first accommodation chamber to feed the developer. In addition, a developer accommodation portion accommodates the developer to be supplied to the first accommodation chamber and is sealed by a sealing member. A controller executes an operation in a mode in which after the developer accommodating portion starts to be unsealed at the sealing member, the feeding screw is initially rotated for a predetermined period in a direction opposite to a normal direction in which the feeding screw is rotated during the image forming operation, and after elapse of the predetermined period, the feeding screw is rotated in the normal direction.

15 Claims, 9 Drawing Sheets

(56) References Cited

U.S. PATENT DOCUMENTS

2015/0220018 A1* 8/2015 Nanno ..... G03G 15/0178
399/167

FOREIGN PATENT DOCUMENTS

| | | | |
|---|---|---|---|
| JP | 2003-186369 | A | 7/2003 |
| JP | 2004-126089 | A | 4/2004 |
| JP | 2006-201528 | A | 8/2006 |
| JP | 2009-265217 | A | 11/2009 |
| JP | 2010-044183 | A | 2/2010 |
| JP | 2011-242639 | A | 12/2011 |

* cited by examiner

IMAGE FORMING APPARATUS HAVING REVERSE DEVELOPER FEEDING

FIELD OF THE INVENTION AND RELATED ART

The present invention relates to an image forming apparatus which uses an electrophotographic method, or the like.

Conventionally, in an image forming apparatus such as a copying machine, an electrostatic latent image is formed on the peripheral surface of its photosensitive drum as an image bearing member, and the electrostatic latent image is developed by its developing device into a visible image.

A developing device is such a device that develops a latent image into a visible image, or a toner image (image formed of toner), by supplying a photosensitive drum with toner. One of the widely used developing devices uses two-component developer, which is a mixture of nonmagnetic toner and magnetic carrier. A development process which uses two-component developer is excellent in stability in terms of the amount of toner charge. Thus, it can form color images which are excellent in tone. Therefore, a developing device which uses two-component developer is preferably used as a developing device for a color image forming apparatus.

It has been well known that a developing method which uses two-component developer is such a method that forms an image by charging toner by the friction between carrier and toner, and causing the charged toner to electrostatically adhere to a latent image. In the case of a developing method such as the above-described one which uses two-component developer, it is important to keep the device stable in the amount by which toner is given a triboelectric charge, in order to provide satisfactory images, more specifically, images which are highly durable and stable. Therefore, it is necessary that the carrier in a developing device remains stable in performance in terms of its ability to charge toner.

In reality, however, while the toner in a developing device is gradually consumed by a development operation, the carrier in a developing device is hardly consumed, and therefore, remains in the developing device. Further, as a developing device is used for development, the carrier in the developing device is stirred along with the toner in the developing device. Therefore, if a developing device increases in the length of its cumulative usage (is used for a long time), toner particles, and particles of external additives to the toner, adhere to the surface of a carrier particle. That is, the carrier is contaminated. As the carrier is contaminated, it reduces in performance in terms of its ability to give a toner triboelectrical charge. In other words, the carrier fails to provide the toner with a sufficient amount of triboelectrical charge, resulting in the formation of defective images, such as a foggy image, the fogginess of which is attributable to scattering of toner.

In the past, in order to deal with the above-described problem, the developer in a developing device, was periodically replaced with a fresh supply of developer by a service person or the like, in order to replace the deteriorated developer in the developing device, that is, the developer which has been used beyond its expected life span. This meant that developer life span determined the length of maintenance service interval.

From the standpoint of what is required of maintenance service personnel, maintenance cost, downtime of an image forming apparatus, the longer the maintenance service interval, the better. Thus, efforts have been made to develop developers which are substantially longer in lift life span, and/or a process that does not make the carrier deteriorate. Currently, however, as images are formed on 30,000 to 50,000 sheets of recording medium, one for one, the developer in a developing device reaches the end of its life span.

Therefore, there have been proposed developing devices enabled to prevent the carrier in two-component developer in the devices from deteriorating in its charging performance. Some of them are provided with an internal device which replenishes them with developer or carrier. They are structured so that as they are replenished with a fresh supply of developer or carrier, the developer therein is allowed to overflow through the developer discharge opening, with which one of their walls is provided, and is recovered. The method employed by these types of developing device is sometimes referred to as "trickle replenishment method" (Japanese Laid-open Patent Application No. S59-100471, for example).

A developing device such as those described above is structured so that as it is continuously replenished with a preset amount of fresh supply of developer or carrier, the developer (deteriorated developer) in the device is gradually replaced with the fresh supply of developer or carrier. Thus, the developer in the developing device remains stable in its properties in terms of developing performance, that is, its ability to charge toner. Therefore, it can prevent an image forming apparatus from reducing in the level of quality at which the apparatus outputs images. Thus, various attempts have been made to increase the interval with which the developer in a developing device has to be replaced, or even, to make it unnecessary for the developer in a developing device to be replaced.

There have been proposed, in Japanese Laid-open Patent Applications No. 2006-201528, and No. 2011-242639, such a technology that keeps an initial supply of developer sealed in a replaceable developing device, or a process cartridge, for an image forming apparatus, in order to prevent the initial supply of developer from coming into contact with ambient air. The reason why the initial supply of developer is kept sealed in the developing device or process cartridge is as follows. That is, if developer is left in contact with such ambient air that is high in temperature and humidity, the developer deteriorates by absorbing moisture. Thus, by the time when a replaceable developing device or process cartridge is started up, it becomes impossible for the initial supply of developer in the device or cartridge to perform as expected.

Another reason why the initial supply of developer in a replaceable developing device or process cartridge is kept sealed is to prevent the problem that the developer in a developing device or process cartridge sometimes leaks while the developing device or process cartridge is transported after being shipped out of manufacturing facilities. In the case of the technology disclosed in Japanese Laid-open Patent Application No. 2006-201528, the developing device or process cartridge is structured so that a sealing member used to keep the initial supply of developer sealed therein is to be removed by a user or a service person in order to unseal the developing device or process cartridge. In the case of the technology disclosed in Japanese Laid-open Patent Application No. 2011-242639, the image forming apparatus, and the developing device or process cartridge therefor, are structured so that as the developing device or process cartridge is installed into the main assembly of the image forming apparatus, and begins to be driven, the seal is removed by being rolled up in order to unseal the developing device or process cartridge.

However, when a developing device or process cartridge such as the one disclosed in Japanese Laid-open Patent Application S59-100471, which is provided with an opening through which developer is to be discharged, is structured so that the initial supply of developer is kept sealed in the developing device or process cartridge as disclosed in Japanese Laid-open Patent Applications No. 2006-201528 or No. 2011-242639, the following problems occurred.

In some cases, by the time when the sealing member by which the initial supply of developer was kept sealed in the developing device or process cartridge was removed, the initial supply of developer had shifted to one side of the stirring chamber of the developing device or process cartridge. Consequently, the highest point of the body of developer in the developing device or process cartridge had become excessively high. Thus, as the developing device began to be driven to circularly move the developer therein, the initial supply of developer was discharged by a substantial amount through the afore-mentioned developer discharge opening. Consequently, the developing device was reduced in the amount of the initial supply of developer before it began to be used for development. This problem is likely to occur in a case where the initial supply of developer is stored in the stirring chamber of the developing device, which is provided with the developer discharge opening.

SUMMARY OF THE INVENTION

Thus, the primary object of the present invention is to provide an image forming apparatus which is capable of preventing the problem that as the sealing member for keeping the initial supply of developer sealed in a developing device is removed, the initial supply of developer is discharged through the developer discharge opening of the developing device by an excessive amount.

According to an aspect of the present invention, there is provided a developing apparatus for developing an electrostatic latent image formed on an image bearing member, said apparatus comprising a developer carrying member configured to carry a developer; a first accommodation chamber configured to accommodate the developer at a position opposing said developer carrying member; a second accommodation chamber provided opposed to said developer carrying member at a position below said first accommodating chamber and configured to accommodate the developer; a feeding screw provided in said first accommodating chamber and configured to feed the developer during an image forming operation; a first communicating portion configured to move the developer from said first accommodating chamber to said second accommodating chamber during the image forming operation; a second communicating portion configured to move the developer from said second accommodating chamber to said first accommodating chamber during the image forming operation; a supply opening configured to supply the developer into said first accommodating chamber; a discharge opening provided adjacent to said second communicating portion and configured to permit discharge of the developer from said first accommodating chamber; a developer accommodating portion provided in said first accommodating chamber and configured to accommodate the developer to be supplied into said first accommodating chamber during an initial operation; a sealing member configured to unsealably seal said developer accommodating portion; and a controller configured to execute, after the developer is supplied from said developer accommodating portion by movement of said sealing member, an operation in a mode in which said feeding screw is rotated for a predetermined time period in a direction opposite to a normal direction in which said feeding screw is rotated during the image forming operation and then is rotated in the normal direction.

Further features of the present invention will become apparent from the following description of exemplary embodiments with reference to the attached drawings.

Figure 6:
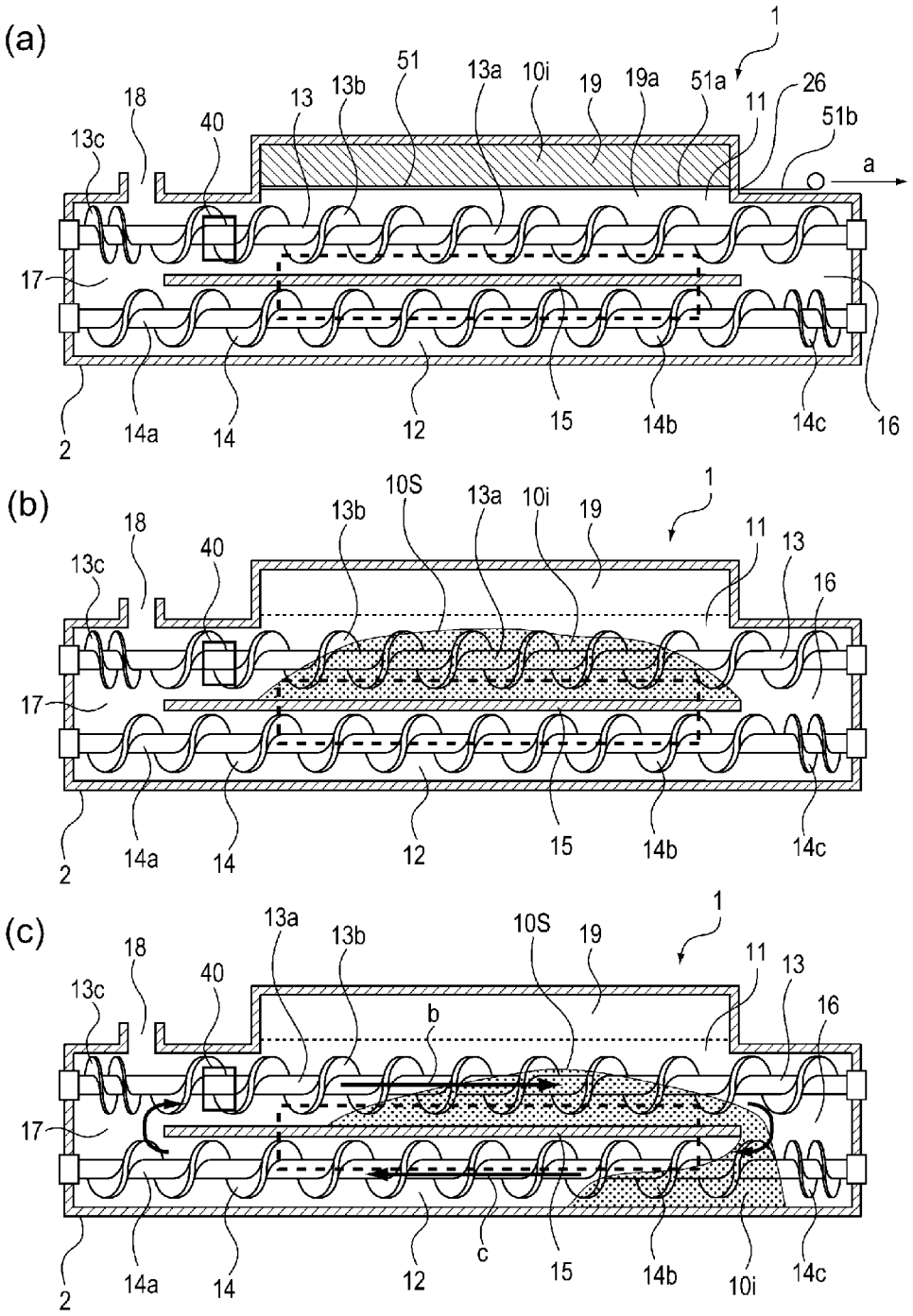

Parts (a)-(c) of FIG. 6 are sectional views of the developing device in the first embodiment during the initialization of the developing device. They show the sequential changes which occurred to the upwardly facing surface of the body of two-component developer in the developing device during the initialization of the developing device.

Figure 7:
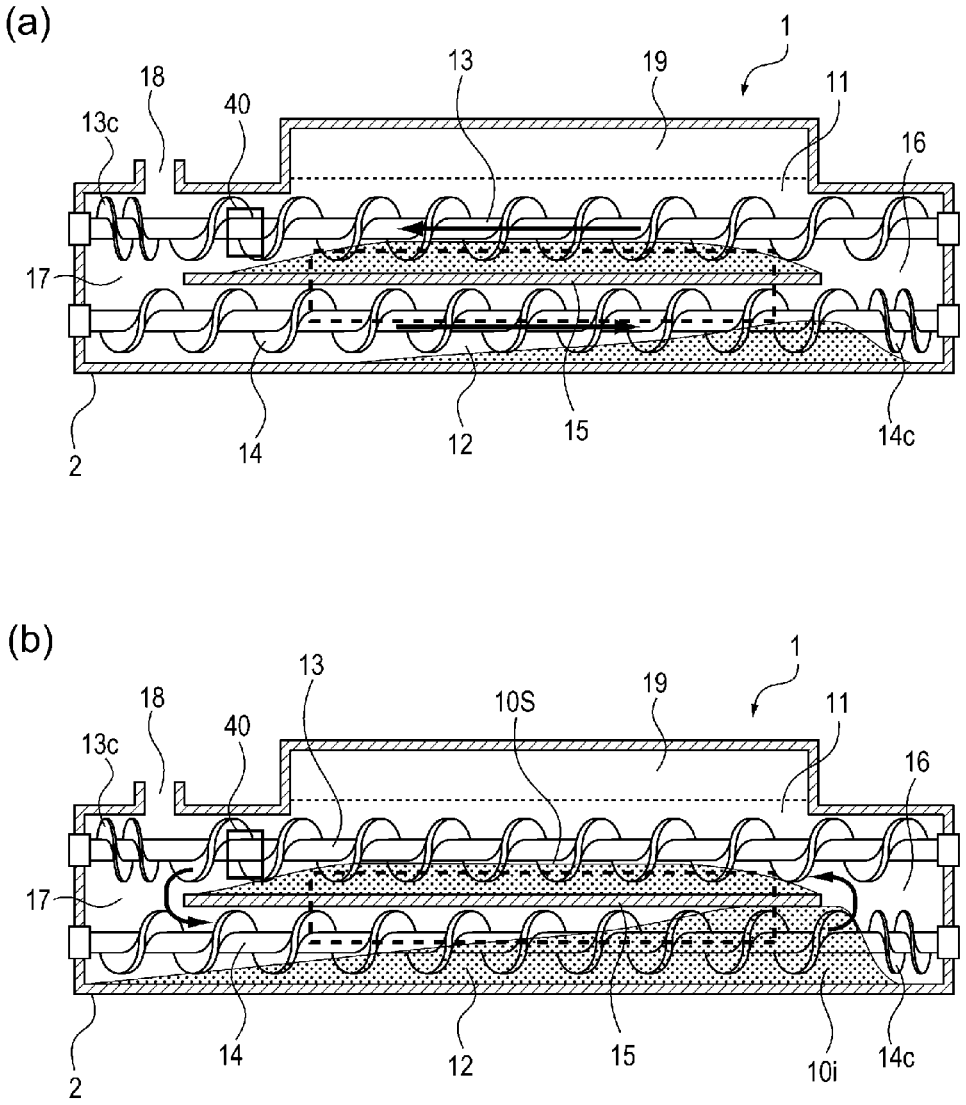

Part (a) and (b) of FIG. 7 are sectional views of the developing device in the first embodiment during the initialization of the developing device. They show the sequential changes which occurred to the upwardly facing surface of the body of two-component developer during the initialization of the developing device.

Figure 8:
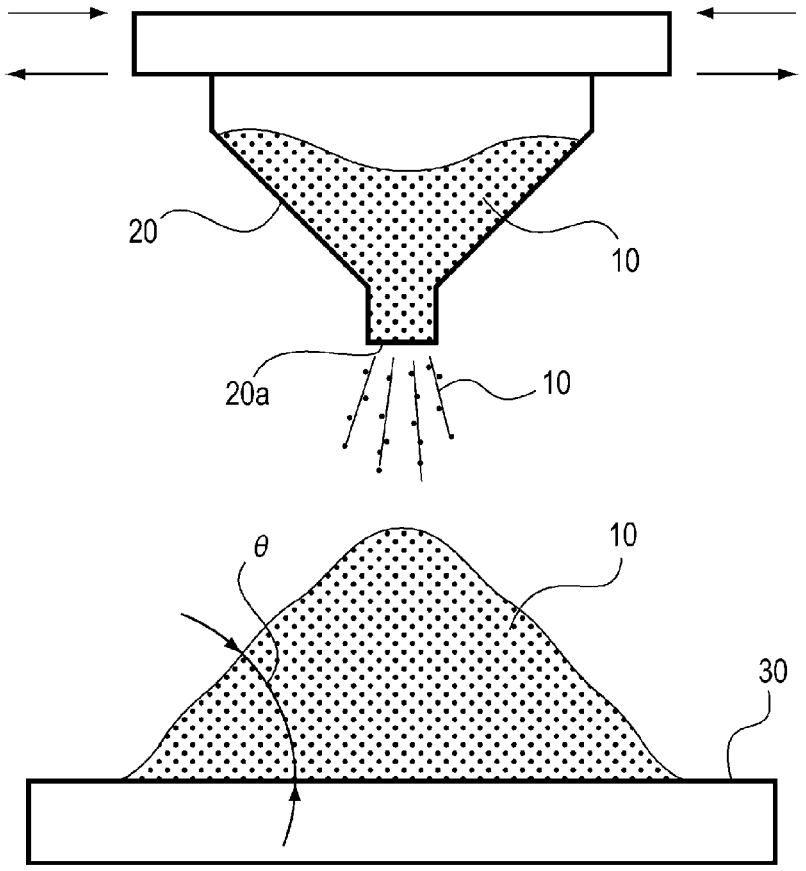

FIG. 8 is a drawing for describing the method for measuring the angle of repose of developer.

Figure 9:
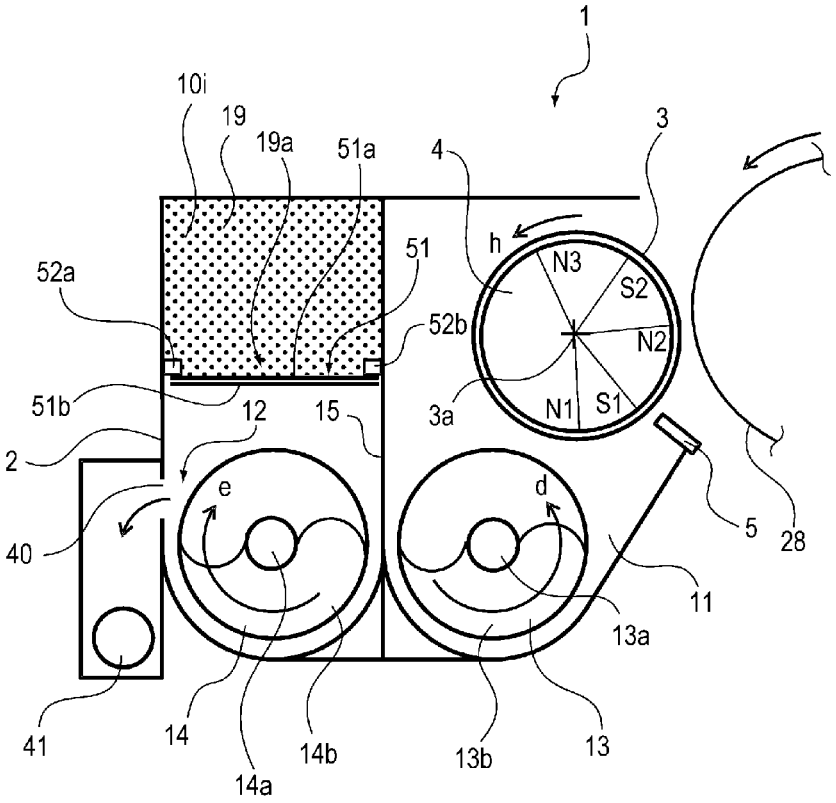

FIG. 9 is a sectional view of the developing device in the second embodiment of the present invention, at a plane perpendicular to the lengthwise direction of the developing device.

Figure 10:
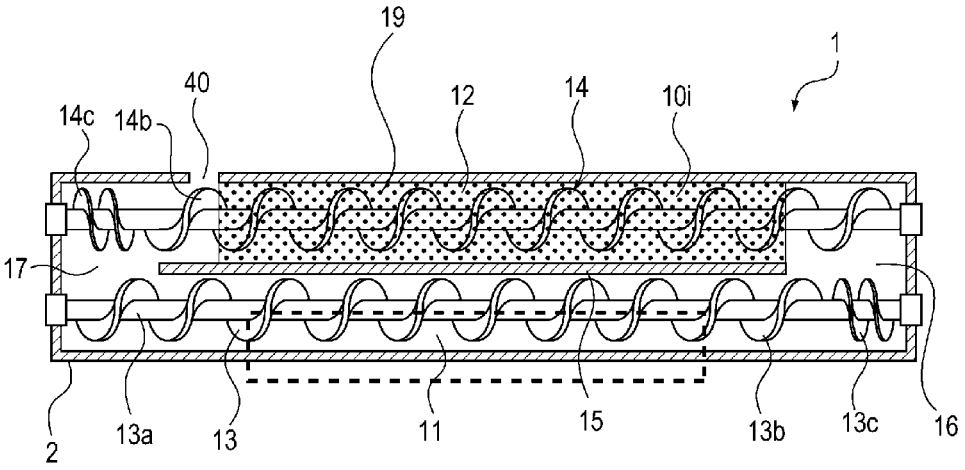

FIG. 10 is a sectional view of the developing device in the second embodiment, at a plane which is parallel to the lengthwise direction of the device.

DESCRIPTION OF THE EMBODIMENTS

Hereinafter, a few embodiments of the present invention are concretely described.

Embodiment 1

To begin with, referring to FIGS. 1-8, the image forming apparatus in the first embodiment of the present invention is described about its structure.

<Image Forming Apparatus>

Figure 1:
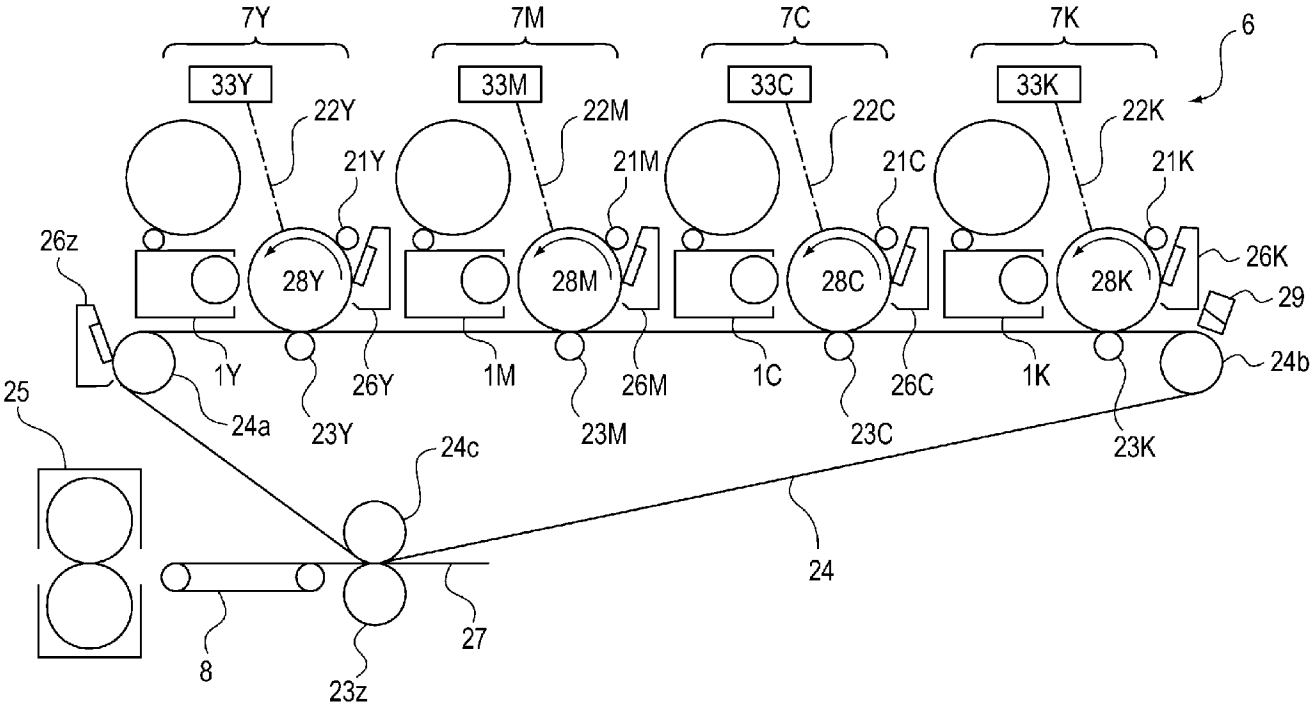
FIG. 1 is a sectional view of one example of an image forming apparatus to which the present invention is applicable.

Referring to FIG. 1, the developing device 1 in this embodiment is an example of developing device used by a full-color image forming apparatus 6 of the so-called tandem type, in which four cartridges 7 for forming yellow (Y), magenta (M), cyan (C) and black (K) toner images, one for one, are aligned in parallel. By the way, for the sake of convenience, the four cartridges 7Y, 7M, 7C and 7K, which form yellow (Y), magenta (M), cyan (C) and black (K) toner images, respectively, are described together as a cartridge 7. The same measures may be used to describe other image forming means.

Each of yellow (Y), magenta (M), cyan (C) and black (K) toner images, is formed on the peripheral surface of the corresponding photosensitive drum 28. Then, the four toner images are transferred one by one (primary transfer) onto the outward surface of an intermediary transfer belt 24 so that they are layered on the intermediary transfer belt 24. Then, the four toner images are transferred together from the intermediary transfer belt 24 onto a sheet 27 of recording medium, which is conveyed by an unshown conveying means. Then, the sheet 27 and the toner images thereon are heated and pressed by a fixing device 25 as a fixing means. Consequently, a full-color image is formed on the sheet 27.

Next, referring to FIG. 1, an image forming operation carried out by each cartridge 7 is described. The photosensitive drum 28, which is an image bearing member, is rotationally driven in the counterclockwise direction in FIG. 1. The peripheral surface of the photosensitive drum 28 is uniformly charged by a charge roller 21 as a charging means. After the peripheral surface of the photosensitive drum 28 is uniformly charged by the charge roller 21, it is exposed to (scanned by) a beam 22 of laser light projected from a laser scanner 33, as an exposing means, while being modulated according to the information of the image to be formed. Consequently, an electrostatic latent image which reflects the information of the image to be formed is effected on the peripheral surface of the photosensitive drum 28.

To the electrostatic latent image on the peripheral surface of the photosensitive drum 28, developer 10 is supplied by the developing device 1. Thus, the electrostatic latent image is developed into a visible image, that is, an image formed of toner, which hereafter will be referred to as a toner image. Each of the four toner images, different in color, formed on the peripheral surface of the corresponding photosensitive drum 28, is transferred onto the outward surface of the intermediary transfer belt 24 by a primary transfer roller 23, so that the four toner images, different in color, are layered on the intermediary transfer belt 24.

The intermediary transfer belt 24 is suspended and kept tensioned by belt suspending rollers 24*a*, 24*b* and 24*c* in such a manner that it can be circularly moved in the clockwise direction. Further, there are provided four primary transfer rollers 23 on the inward side of the loop which the intermediary transfer belt 24 forms, in such a manner that they oppose the four photosensitive drums 28, one for one.

The toner which is remaining on the peripheral surface of the photosensitive drum 28 after the transfer of a toner image from the photosensitive drum 28 onto the intermediary transfer belt 24 is removed (scraped away) by a cleaner 26 as a cleaning means.

After being transferred onto the intermediary transfer belt 24 (primary transfer), the four toner images are transferred together (secondary transfer) by a secondary transfer roller 23*z*, which is a secondary transferring means, onto the sheet 27 of recording medium such as paper. Then, the sheet 27 is conveyed to the fixing device 25 by a conveyer belt 8. Then, the sheet 27 is conveyed through the fixing device 25 while remaining pinched between the heat roller and pressure roller of the fixing device 25, being thereby subjected to the heat and pressure from the heat roller and pressure roller. Consequently, the toner images on the sheet 27 are thermally fixed to the sheet 27.

The toner which is remaining on the outward surface of the intermediary transfer belt 24 after the secondary transfer of the toner images onto the sheet 27 of recording medium is removed (scraped away) by a belt cleaner 26*z* as a cleaning means.

<Developing Device>

Figure 2:
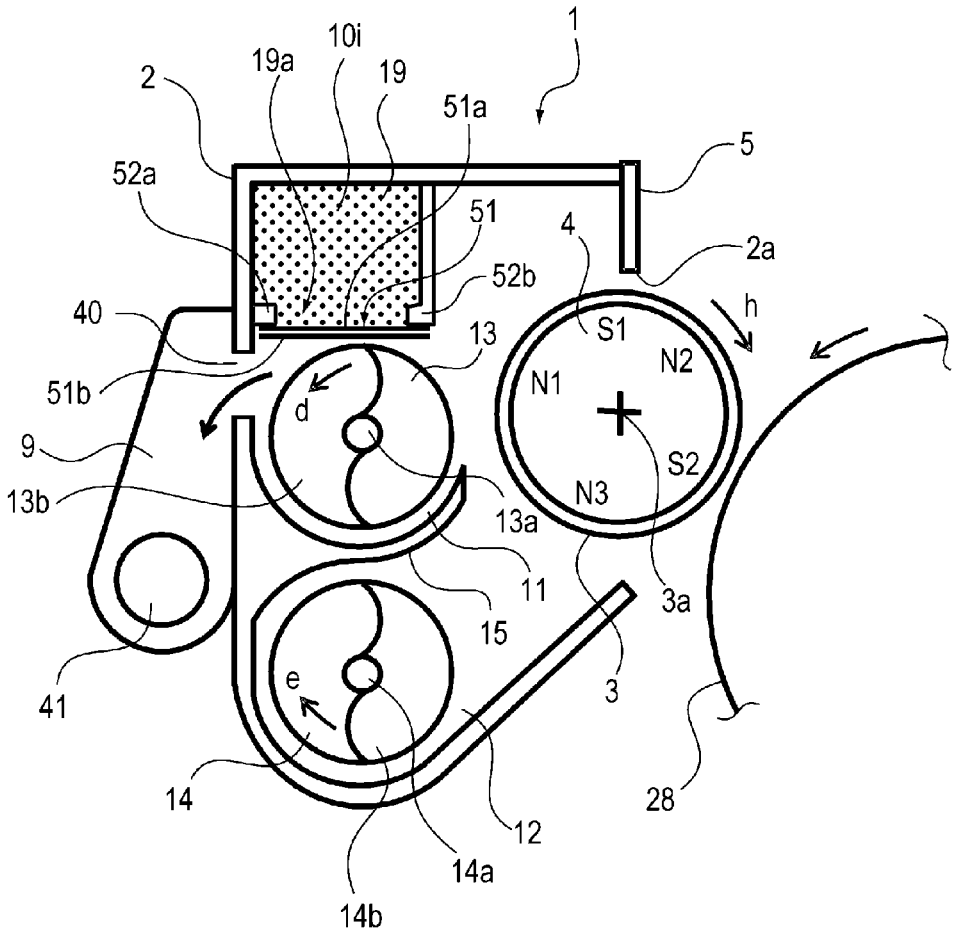
FIG. 2 is a sectional view of the developing device in the first embodiment of the present invention, at a plane which is perpendicular to the lengthwise direction of the developing device. It is for describing the structure of the device.
Figure 3:
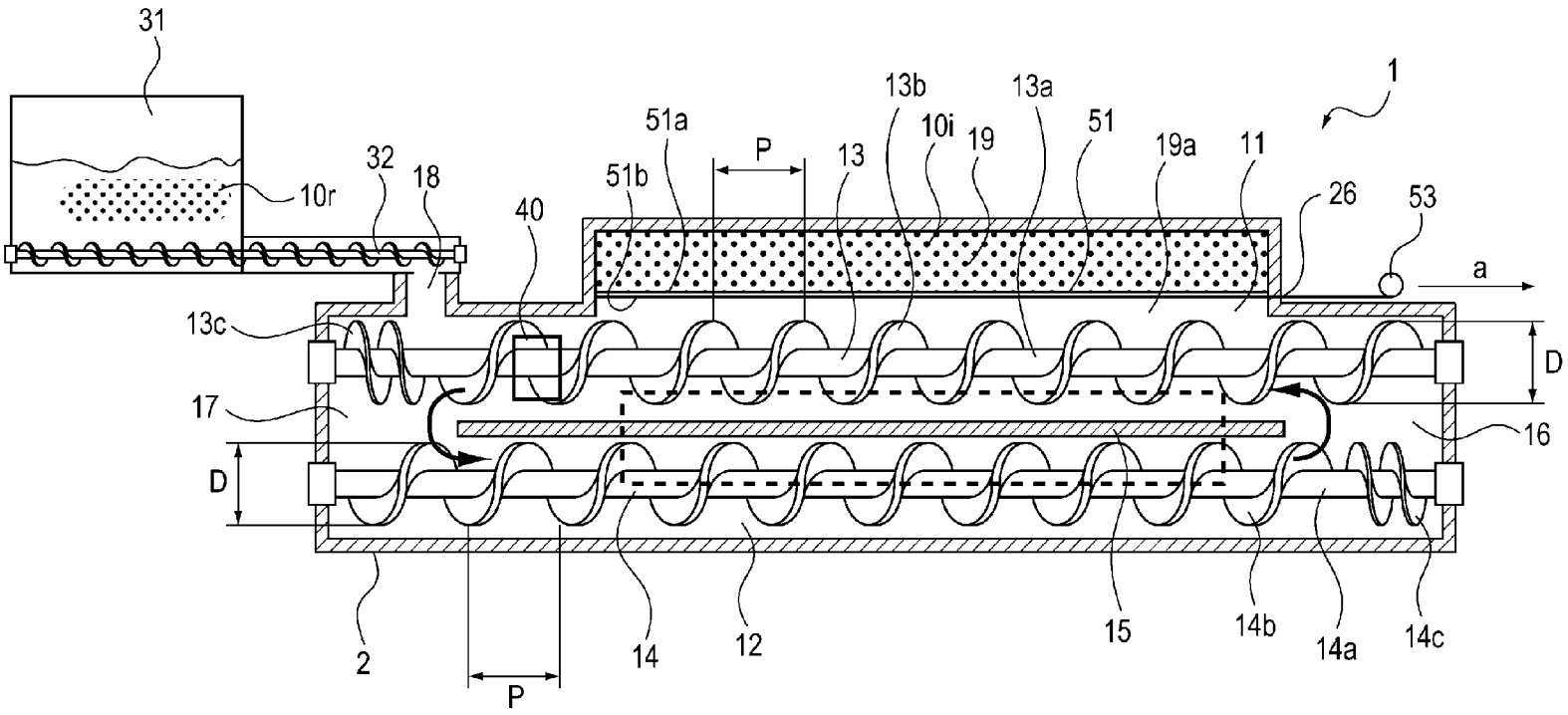
FIG. 3 is a sectional view of the developing device in the first embodiment of the present invention, at a plane which is parallel to the lengthwise direction of the developing device. It is for describing the structure of the device.

Next, referring to FIGS. 2 and 3, the developing device 1 is described about its structure. FIGS. 2 and 3 are sectional views of the developing device 1 in this embodiment. They are for describing the structure of the developing device 1.

The developing device 1 in this embodiment has a developer container 2 which has a pair of developer holding chambers, more specifically, a development chamber 11 (first developer holding chamber) and a stirring chamber 12 (second developer holding chamber).

The development chamber 11 has a development sleeve 3. It holds the developer 10 in such a manner that the development sleeve 3 is supplied with developer 10.

The developing device 1 is structured so that the stirring chamber 12 is positioned under the development chamber 11, and the primary opening of the stirring chamber 12 faces the development sleeve 3. The stirring chamber 12 recovers the developer from the development sleeve 3.

The developer container 2 contains the developer 10 which is two-component developer made up of toner and carrier.

The developer container 2 contains the development sleeve 3 which bears and conveys the developer 10 in the developing device 2 and supplies the peripheral surface of the photosensitive drum 28 with the developer 10. Further, the developer container 2 is provided with a regulation blade 5, which functions as a member for regulating in height a "magnetic brush" which the body of developer 10 borne on the peripheral surface of the development sleeve 3 forms.

In this embodiment, there is a partition wall 15 in the developer container 2. The partition wall 15 extends in the direction parallel to the lengthwise direction (left-right direction in FIG. 3) of the developer container 2. It extends also in the direction perpendicular to the surface of the sheet of paper on which FIG. 3 is drawn. It separates the developer container 2 into top and bottom chambers, that is, the aforementioned development chamber 11 and stirring chamber 12.

Referring to FIGS. 2 and 3, the development chamber 11 and stirring chamber 12 contain the first and second conveyance screws 13 and 14, respectively, which function as conveying members for conveying the developer 10 in such a manner that the developer 10 moves alternately through the development chamber 11 and stirring chamber 12 while being stirred.

In this embodiment, the first and second conveyance screws 13 and 14 are provided with spiral blades 13*b* and 14*b*, respectively, which are 20 mm in external diameter D and 20 mm in pitch, and which are attached to the peripheral surface of the rotational shaft 13*a* of the first conveyance screw 13, and the peripheral surface of the rotational shaft 14*a* of the second conveyance screw 14, respectively.

The first conveyance screw 13 is disposed in the bottom portion of the development chamber 11. It extends roughly in parallel to the axial line of the development sleeve 3 (left-right direction in FIG. 3). Normally, the first conveyance screw 13 is rotated in the forward direction (which hereafter may be referred to as normal direction) indicated by an arrow mark d in FIG. 2 to convey the developer 10 in the development chamber 11 in the direction (leftward in FIG. 3) which is parallel to its shaft.

The reason why the normal direction in which the first conveyance screw 13 is to be rotated is made to be the direction indicated by the arrow mark d in FIG. 2 is that rotating the first conveyance screw 13 in the direction indicated by the arrow mark d is advantageous from the standpoint of supplying the development sleeve 3, shown in FIG. 2, with the developer 10.

The second conveyance screw 14 is disposed in the bottom portion of the stirring chamber 12. It extends roughly in parallel to the shaft of the first conveyance screw 13 (left-right direction in FIG. 3). Normally, the second conveyance screw 14 is rotated in the forward direction (which hereafter may be referred to as normal direction) indicated by an arrow mark e in FIG. 2, which is opposite from the rotational direction of the first conveyance screw 13, to convey the developer 10 in the stirring chamber 12 in the opposite direction (rightward in FIG. 3) from the normal developer conveyance direction of the first conveyance screw 13.

As described above, the developer 10 in the development chamber 11 and the developer 10 in the stirring chamber 12 are conveyed in the counterclockwise direction of FIG. 3 by the rotation of the first and second conveyance screws 13 and 14, while being stirred by the first and second conveyance screws 13 and 14, so that the developer 10 is circularly moved in the developer container 2, alternately through the development chamber 11 and stirring chamber 12. That is, the developer 10 in the developer container 2 is circularly moved in the developer container 2 in such a manner that it is conveyed upward from the stirring chamber 12 into the development chamber 11 through a developer passage 16 (first developer passage), which is one of the two passages located at the lengthwise ends (in terms of left-right direction in FIG. 3) of the partition wall 15 shown in FIG. 3, is conveyed leftward through the development chamber 11, and then, is conveyed downward from the development chamber 11 into the stirring chamber 12 through a developer passage 17 (second developer passage), which is the other of the aforementioned two passages.

The developer container 2 is provided with an opening 2*a*, which faces the photosensitive drum 28 and corresponds in position to the development area. The development sleeve 3 is rotatably supported by the developer container 2 so that it is partially exposed from the developer container 2 toward the photosensitive drum 28, through the opening 2*a*.

In this embodiment, the development sleeve 3 and photosensitive drum 28 are 20 mm and 80 mm, respectively, in external diameter. They are positioned so that the smallest distance between the two is roughly 300 μm. Thus, the electrostatic latent image on the peripheral surface of the photosensitive drum 28 is developed by the developer 10 as the developer is borne on the peripheral surface of the development sleeve 3 and conveyed through the development area by the rotation of the development sleeve 3, with the developer 10 on the development sleeve 3 being in contact with the peripheral surface of the photosensitive drum 28.

By the way, the development sleeve 3 in this embodiment is formed of a nonmagnetic substance. There is disposed a stationary magnetic roller 4, as a magnetic field forming means, in the hollow of the development sleeve 3. The magnetic roller 4 has a magnetic pole S2. It is disposed in such an attitude that it is in the development area that the magnetic pole S2 opposes the photosensitive drum 28. Further, the magnetic roller 4 has a magnetic pole N1 which functions as the means for regulating in height the aforementioned "magnetic brush" which the developer 10 on the peripheral surface of the photosensitive drum 28 forms. The magnetic roller 4 is disposed in such an attitude that the magnetic pole N1 opposes the regulation blade 5 as the member for regulating in height the aforementioned "magnetic brush" which the developer 10 on the peripheral surface of the development sleeve 3 forms. Further, the magnetic roller 4 is provided with magnetic poles S1, N2 and N3, which are between the above-described magnetic poles N1 and S2. The magnetic roller 4 is disposed in such an attitude that the magnetic pole N3 opposes the stirring chamber 12.

While the development sleeve 3 is used for development, it rotates in the counterclockwise direction in FIG. 3. As the development sleeve 3 rotates, it bears the developer 10, which is two-component developer. Further, as the development sleeve 3 rotates, the layer of the developer 10 on the development sleeve 3 is regulated in thickness by the regulation blade 5, which functions to regulate in height the "magnetic brush" which the developer 10 on the development sleeve 3 forms. Then, as the development sleeve 3 rotates further, it conveys the portion of the layer of the developer 10 on the development sleeve 3, which has just been regulated in thickness, to the development area, in which it develops the electrostatic latent image formed on the peripheral surface of the photosensitive drum 28, into a toner image, by supplying the latent image with the developer 10.

While the peripheral surface of the photosensitive drum 28 is supplied with the developer 10 on the development sleeve 3, development voltage, which is a combination of DC voltage and AC voltage, is applied to the development sleeve 3 from a development bias power source, in order to increase the developing device 1 in development efficiency (amount by which toner is adhered to electrostatic latent image). In this embodiment, the development bias (voltage) is a combination of DC voltage which is −500 V in magnitude, and AC voltage which is 1800 V in peak-to-peak voltage Vpp, and 12 kHz in frequency f. However, the DC voltage and the waveform of the AC voltage do not need to be the same in value as those in this embodiment.

The regulation blade 5, which is a member for trimming the "magnetic brush", is a long and narrow rectangular member formed of a nonmagnetic substance such as aluminum or the like. That is, it is a long and narrow rectangular piece of aluminum plate or the like. It is disposed so that its lengthwise edges are parallel to the lengthwise direction of the development sleeve 3. Referring to FIG. 2, the regulation blade 5 is disposed on the upstream side of the photosensitive drum 28 in terms of the rotational direction of the development sleeve 3. Both the toner and carrier in the developer 10 are conveyed through the gap between the regulating edge of the regulation blade 5 and the peripheral surface of the development sleeve 3, and then, are sent to the development area in which they oppose the peripheral surface of the photosensitive drum 28.

By the way, as the amount of the gap between the regulating edge of the regulation blade 5 and the peripheral surface of the development sleeve 3 is adjusted, the amount by which the magnetic brush, which the developer 10 borne on the peripheral surface of the development sleeve 3 forms, is regulated in height is determined, whereby the amount by which the developer 10 is conveyed to the development area in which the developer 10 on the development sleeve 3 opposes the photosensitive drum 28. In this embodiment, the amount by which the developer 10 coated on the peripheral surface of the development sleeve 3 is allowed to remain on the peripheral surface of the development sleeve 3 per unit area by the regulation blade 5 was set to 30 mg/cm$^2$.

As for the amount of the gap between the regulating edge of the regulation blade 5 and the peripheral surface of the development sleeve 3, it is desired to be set to 200 μm-1000 μm, preferably, 300 μm-700 μm. In this embodiment, it was set to 500 μm.

The development sleeve 3, which is rotatably supported in the developing device 1, is rotated in the aforementioned normal direction, in the development area in which the development sleeve 3 opposes the photosensitive drum 28, its peripheral surface moves in the same direction (indicated by arrow mark h in FIG. 2) as the peripheral surface of the photosensitive drum 28 which is rotated in the counterclockwise direction in FIG. 2). As for the ratio in peripheral velocity between the development sleeve 3 and photosensitive drum 28, the peripheral surface of the development sleeve 3 is 1.75 times the peripheral surface of the photosensitive drum 28.

Also regarding the ratio in peripheral velocity between the development sleeve 3 and photosensitive drum 28, all that is necessary is that the peripheral surface of the photosensitive drum 3 is 1.0-3.0, preferably, 1.0-2.5, times the peripheral surface of the photosensitive drum 28. Further, the greater the ratio in peripheral velocity between the development sleeve 3 and photosensitive drum 28, the higher the development efficiency. However, if the ratio is excessively large, such problems as scattering of toner and developer deterioration occur. Thus, it is desired that the ratio in peripheral velocity between the development sleeve 3 and photosensitive drum 28 is set to a value within the above-described range.

<Two-Component Developer>

Next, the developer 10 used in this embodiment is described. It is two-component developer, and its primary components are toner and carrier. The toner is a mixture of colored resinous particles made up of bonding resin, coloring agent, and additives added as necessary, and colored particles of external additives such as microscopic particles of colloidal silica. The toner is made up of polyester resin which is negatively chargeable. It is desired to be no less than 4 μm and no more than 10 μm, preferably, no more than 7 μm, in volume average particle diameter.

As the carrier, particles of iron, the surface of which has been oxidized, or particles of iron, nickel, cobalt, manganese, chrome, rare-earth metal, or the like, alloys of preceding substance, ferrite oxide, or the like can be preferably used. There is no requirement regarding the method for manufacturing these magnetic particles.

The carrier is desired to be 20 μm-60 μm, preferably, 30 μm-50 μm, in weight average particle diameter. It is desired to be no less than $1\times10^7$ Ω·cm, preferably, no less than $1\times10^8$ Ω·cm, in resistivity. In this embodiment, the carrier which was $1\times10^8$ Ω·cm in resistivity was used.

In this embodiment, a mixture of toner and carrier, which was 8% in T/D ratio (toner ratio of developer 10), that is, 8:92 in mass ratio between toner and carrier, was used as initial developer 10*i* (initial supply of developer 10). By the way, "T/D ratio" means the ratio in weight of nonmagnetic toner (T) relative to the developer (D) which is a mixture of magnetic carrier and nonmagnetic toner.

<Method for Replenishing Developing Device with Developer>

Next, referring to FIG. 3, the method used in this embodiment for replenishing the developing device 1 with developer 10 is described. Referring to FIG. 3, the developing device 1 is provided with a hopper 31, which is a means for replenishing the developer container 2 with replenishment two-component developer 10*r*. The hopper 31 is attached to the top side of the developing device 1. It contains (stores) the replenishment two-component developer 10*r*.

Referring again to FIG. 3, the hopper 31 is provided with a replenishment screw 32, which has a spiral blade and is disposed in the bottom portion of the hopper. One of the lengthwise ends of the replenishment screw 32 extends to the top of a replenishment opening 18, with which the front end portion of the developing device 1 is provided.

As the toner in the developing device 1 is consumed by an image forming operation which uses the developer 10 in the developing device 1, the replenishment two-component developer 10*r* in the hopper 31 is delivered by the amount equivalent to the amount by which the toner was consumed, into the development chamber 11 of the developer container 2 by the rotation of the replenishment screw 32 and the weight of the replenishment two-component developer 10*r* itself, through the replenishment opening 18 of the hopper 31. This is how the replenishment two-component developer 10*r* is delivered from the hopper 31 into the developing device 1.

In this embodiment, such developer that is 90% in T/D ratio, that is, ratio, in mass, of the toner relative to the developer (mixture of toner and carrier) was used as the replenishment two-component developer 10*r*.

The amount by which the replenishment two-component developer 10*r* is delivered to the developing device 1 is determined by the approximate number of revolutions of the replenishment screw 32 as a conveying member. The number of revolutions of the replenishment screw 32 is determined by an unshown controlling portion which determines the amount by which toner is to be delivered. As for the method for controlling the amount by which toner is delivered, various methods are available. For example, the developer 10 in the developer container 2, which is a mixture of toner and carrier, may be optically or magnetically measured in toner density, or a toner image obtained by developing a latent image formed on the peripheral surface of the photosensitive drum 28, may be measured in toner density. That is, the method for controlling the amount by which toner is delivered into the developer container 2 is optional. By the way, the method used in this embodiment is one of examples of supplying the developing device 1 with carrier by mixing carrier into the replenishment developer. However, an image forming apparatus (developing device) may be structured so that carrier is independently supplied from the toner.

<Method for Discharging Developer>

Next, referring to FIG. 2, a method used in this embodiment to discharge the developer 10 from the developing device 1 is described. As shown in FIG. 2, one of the walls of the development chamber 11 of the developer container 2 of the developing device 1 is provided with a discharge opening 40 for discharging a part of the developer 10 in the development chamber 11 of the developer container 2.

As the developer 10 in the developer container 2 is used for image formation, it gradually deteriorates. Thus, the developing device 1 is structured so that during an image forming operation, the developer 10 in the developer container 2 is continuously discharged by a certain amount from the discharge opening 40 into the recovery chamber 9, as shown in FIG. 2. However, the developer container 2 is continuously replenished with the replenishment two-component developer 10*r* as the toner in the developer container 2 is consumed for image formation. Therefore, the developer container 2 increases in the amount of the developer 10 therein. Consequently, the developer 10 in the developer container 2 overflows from the developer container 2 through the discharging opening 40, into the recovery chamber 9 to be recovered. The amount by which the developer 10 is discharged (overflows) is proportional to the amount by which the developer container 2 is increased in the amount of developer 10 therein by the developer replenishment. As the developer 10 is discharged into the recovery chamber 9, the developer 10 in the recovery chamber 9 is conveyed to an unshown recovery developer container by the rotation of the recovery screw 41, as a conveying member, which has a spiral blade, and recovered into the recovery container.

By the way, in this embodiment, in terms of the normal direction in which the developer 10 is conveyed in the development chamber 11, the discharge opening 40 is positioned at the downstream end portion (left end portion in FIG. 3) of the development chamber 11, which is likely to be less in the height of the developer surface 10*s* (ridge) of the body of developer 10 than the upstream end portion.

In terms of the vertical direction, the discharge opening 40 is positioned to prevent the problem that the developer 10 in the development chamber 11 is discharged by an amount large enough to make the amount of the developer 10 in the developer container 2 less than the amount necessary to reliably keep the peripheral surface of the development sleeve 3 properly coated for satisfactory development.

Therefore, the developer 10 in the developing device 1 overflows from the development chamber 11 only when the amount of the developer 10 in the developing device 1 is made to exceed the proper amount for satisfactory development, by the replenishment of the developing device 1 with the replenishment two-component developer 10*r*. Further, as the surface 10*s* (ridge) of the developer 10 in the development chamber 11 falls below the discharge opening 40, the developer 10 naturally stops being discharged through the discharge opening 40. Thus, it is possible for the peripheral surface of the development sleeve 3 to be reliably coated with a proper amount of developer 10.

Referring to FIG. 3, in this embodiment, the discharge opening 40 was formed on the upstream side of the replenishment opening 18 in terms of the normal direction (rightward in FIG. 3) in which the developer 10 is conveyed during development. Therefore, it does not occur that a part of a fresh supply of replenishment two-component developer 10*r* is discharged through the discharge opening 40 as soon as the fresh supply of replenishment two-component developer 10*r* is delivered into the development chamber 11.

<Method for Keeping Initial Supply of Developer in Development Chamber>

Next, referring to FIGS. 2 and 3, how the developing device 1 in this embodiment is structured to keep the initial supply 10*i* of developer 10 (which hereafter will be referred to simply as initial developer 10*i*) is kept sealed in the development chamber 11 is described. In this embodiment, the initial developer 10*i* is stored in a storage chamber 19 formed as the top portion of the development chamber 11, and is kept sealed in the storage chamber 19 with the use of a removable sealing sheet 51. The storage chamber 19 is provided on the upstream side (right-hand side in development chamber 11 in FIG. 3) of the discharge opening 40 in terms of the normal developer conveyance direction for development.

The sealing sheet 51 keeps the initial developer 10*i* sealed in the developing device 1 to prevent the initial developer 10*i* from leaking out of the developing device 1 prior to the initialization of the developing device 1.

<Initialization Operation>

In the normal initialization operation, the sealing sheet 51 is removed to release the initial developer 10*i* into the development chamber 11, and then, the developing device 1 is idly rotated. Then, an operation for initializing an unshown inductance detecting portion for detecting the toner density of the developer 10 (initial supply of developer 10*i*) in the development chamber 11 is carried out (value is set for referential control voltage). Thereafter, a patch (toner image), as a referential image for detecting the toner density, is formed on the peripheral surface of the photosensitive drum 28. Then, the amount by which toner adhered to the peripheral surface of the photosensitive drum 28 to form the patch (toner image) is detected (initial amount by which toner adhered to photosensitive drum 28 is detected).

In a case where the sealing sheet 51 is to be manually removed by a service person or a user, the following operation is carried out. That is, the sealing sheet 51 is removed from a brand-new developing device 1. Then, the brand-new developing device 1 is set in the main assembly of the image forming apparatus 6. Next, an unshown initialization button is pressed by the service person or user.

What occurs as the initialization button (inputting portion) is pressed is as follows, no matter whether the developing device 1 in the image forming apparatus 6 has already been initialized, or it is brand-new. That is, as the initialization button is pressed, signals for causing the developing device 1 to carry out a preprogrammed initialization operation by driving the first and second conveyance screws 13 and 14 is inputted into a CPU 60 as a controlling means.

Thus, the CPU 60 receives the initialization signals, which are the signals to be inputted as the initialization button (inputting portion) is pressed. Consequently, the first and second conveyance screws 13 and 14 are rotated in the opposite direction from the normal direction in which they are rotated in the normal development operation. Thereafter, the developing device 1 is operated in the mode in which the first and second conveyance screws 13 and 14 are rotated in their normal direction while being controlled in rotation.

On the other hand, in a case where the sealing sheet 51 is automatically removed by an unshown means for taking up the sealing sheet 51, that is, in a case where the sealing sheet 51 is automatically removed, the following operation is carried out. As a service person or a user presses the unshown initialization button, the sealing sheet 51 is automatically taken up by an unshown means for taking up the sealing sheet 51 to unseal the storage chamber 19. At the same time, the CPU 60, as a controlling means, receives the initialization signals. Thus, the CPU 60 causes the first and second conveyance screws 13 and 14 to rotate in the opposite direction from the normal direction for development, in response to these initialization signals. Thereafter, the two conveyance screws 13 and 14 are rotated in their normal rotational direction for development.

In a case where the developing device 1 is provided with a sensor 64 for detecting whether or not the installed developing device 1 is brand-new, and it is detected by the sensor 64 that the developing device 1 set in the main assembly of the image forming apparatus 6 is brand-new, the following operation is carried out. The initialization operation is automatically started so that the sealing sheet 51 is automatically taken up by the unshown means for taking up the sealing sheet 51 to unseal the storage chamber 19. At the same time, the CPU 60, as a controlling means, receives the initialization signal. Thus, the first and second conveyance screws 13 and 14, as conveying members, are rotated in the opposite direction from the normal direction in which the two screws 13 and 14 are rotated for development. Thereafter, the image forming apparatus 6 is operated in the mode in which the first and second conveyance screws 13 and 14 are rotated in the normal direction for development, before the initialization operation is started in response to the initialization signals.

As described above, the operational sequence in which the sealing sheet 51 is removed; the first and second conveyance screws 13 and 14 are rotated in the opposite direction from the normal direction in which they are rotated for development; and then, the first and second conveyance screws 13 and 14 are rotated in the normal direction for development, is carried out as a preliminary initialization operation before the above-described normal initialization operation is started.

By the way, in the initialization operation for the developing device 1 in this embodiment, it is detected by the developing device status sensor 64 whether or not the developing device 1 set in the main assembly of the image forming apparatus 6 is brand-new. In this case, the initialization operation is such an operation that the sealing sheet 51 is removed, and the first and second conveyance screws 13 and 14 are rotated in the opposite direction from their normal direction for development.

Referring to FIG. 3, in this embodiment, the development chamber 11, which functions as a storage chamber in which the initial developer 10*i* (initial supply of developer 10) is kept sealed, is provided with the discharge opening 40. Of the two developer storage chambers, which are the development chamber 11 and stirring chamber 12, the development chamber 11 in which the initial supply of developer 10*i* is kept sealed by the sealing sheet 51, and which is provided with the discharge opening 40, are disposed above the stirring chamber 12 which functions as the other developer storage chamber.

Referring to FIGS. 2 and 3, in this embodiment, the development chamber 11 is placed on top of the stirring chamber 12. Therefore, there is little space above the stirring chamber 12. However, there is a relatively large space above the development chamber 11. Thus, it is easier to place the storage chamber 19, in which the initial developer 10*i* is to be kept sealed, above the development chamber 11.

The second conveyance screw 14 disposed in the stirring chamber 12 is required to push the developer 10 up into the development chamber 11 which is on top of the stirring chamber 12. Thus, the second conveyance screw 14 is likely to be subjected to a larger amount of load than the first conveyance screw 13; it needs to be provided with a larger amount of torque. Therefore, if the initial developer 10*i* in the stirring chamber 12 shifts to one side of the stirring chamber 12, the second conveyance screw 14 is subjected to much greater amount of load, making it possible for the second conveyance screw 14 to unexpectedly lock up. In this embodiment, therefore, the initial developer 10*i* is kept sealed in the top portion of the development chamber 11 provided with the discharge opening 40, as shown in FIG. 3, until the developing device 1 is initialized.

In this embodiment, the initial developer 10*i* is kept sealed in the storage chamber 19, with which the top portion of the development chamber 11 of the developer container 2 of the developing device 1 is provided, until the developing device 1 is initialized. Further, the storage chamber 19, in which the initial developer 10*i* is kept sealed, is above the first conveyance screw 13 which is rotatably disposed in the development chamber 11.

Referring to FIG. 2, one of the walls of the storage chamber 19 in the top portion of the development chamber 11 of the developer container 2 is provided with a pair of ribs 52*a* and 52*b*, to which the sealing sheet 51 is removably adhered.

Referring to FIG. 2, to the bottom surface of each of the ribs 52*a* and 52*b*, the adhesive margin portion 51*a* of the sealing sheet 51 is adhered in a manner to separate the top portion of the development chamber 11 from the bottom portion of the development chamber 11. That is, the storage chamber 19 is made up of the sealing sheet 51, and the walls of the developer container 2, which are provided with the ribs 52*a* and 52*b*, one for one.

When the developing device 1 is shipped out from its factory, the initial developer 10*i* remains sealed in the storage chamber 19, which is the top portion of the development chamber 11, by the sealing sheet 51. Thus, neither carrier or toner of which the developer 10 is made up is present in neither the stirring chamber 12, nor the portion of the development chamber 11, which is on the bottom side of the sealing sheet 51.

Referring to FIG. 3, the sealing sheet 51 is extended from the upstream end (right end in FIG. 3) of the development chamber 11 in terms of the normal developer conveyance direction, to the downstream end (left end in FIG. 3), in a manner to separate the development chamber 11 into the top and bottom portions. Then, it is folded back at the downstream end (left end in FIG. 3).

Referring to FIG. 3, the folded-back portion 51*b* of the sealing sheet 51 is extended upstream from the downstream end (left end in FIG. 3) of the storage chamber 19 beyond the upstream end of the storage chamber 19, through an opening 2*b* with which the upstream wall of the developer container 2 is provided. The upstream end of the folded-back portion 51*b* of the sealing sheet 51 is provided with a tab 53.

The sealing sheet 51 in this embodiment is to be removed by a user or a service person. That is, a user or a service person is to grip the tab 53, and pull the folded-back portion 51*b* in the direction indicated by an arrow mark a in FIG. 3. As the folded-back portion 51*b* is pulled, the adhesive margin portion 51*a* is separated from the bottom surface of the rib 52*a* and that of the rib 52*b*. Consequently, the opening 19*a* of the storage chamber 19 is exposed.

Thus, the top and bottom portions of the development chamber 11, which has remained partitioned from each other by the sealing sheet 51, are united. Regarding the removal of the sealing sheet 51, the image forming apparatus 6 (developing device 1) may be structured so that the sealing sheet 51 is automatically removed by an automatic sheet winding device, that is, without need for the manual intervention from a user or the like.

By the way, regarding the location of the storage chamber 19 which is the top portion of the development chamber 11, and in which the initial developer 10*i* is kept sealed, in terms of the normal developer conveyance direction for development, the storage chamber 19 is positioned on the upstream side (right side in FIG. 3) of the discharge opening 40, as shown in FIG. 3.

Figure 4:
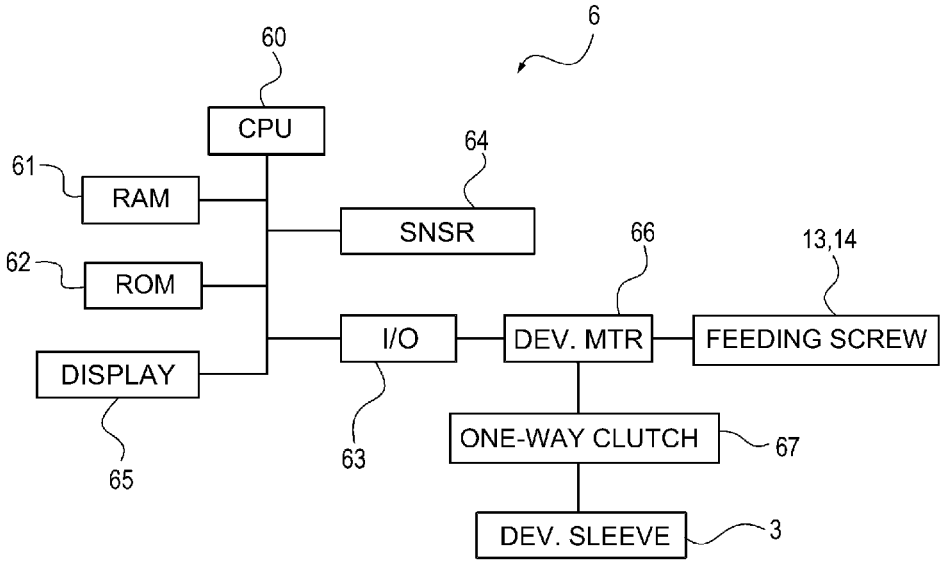
FIG. 4 is a block diagram of the control system of the image forming apparatus in the first embodiment.
Figure 5:
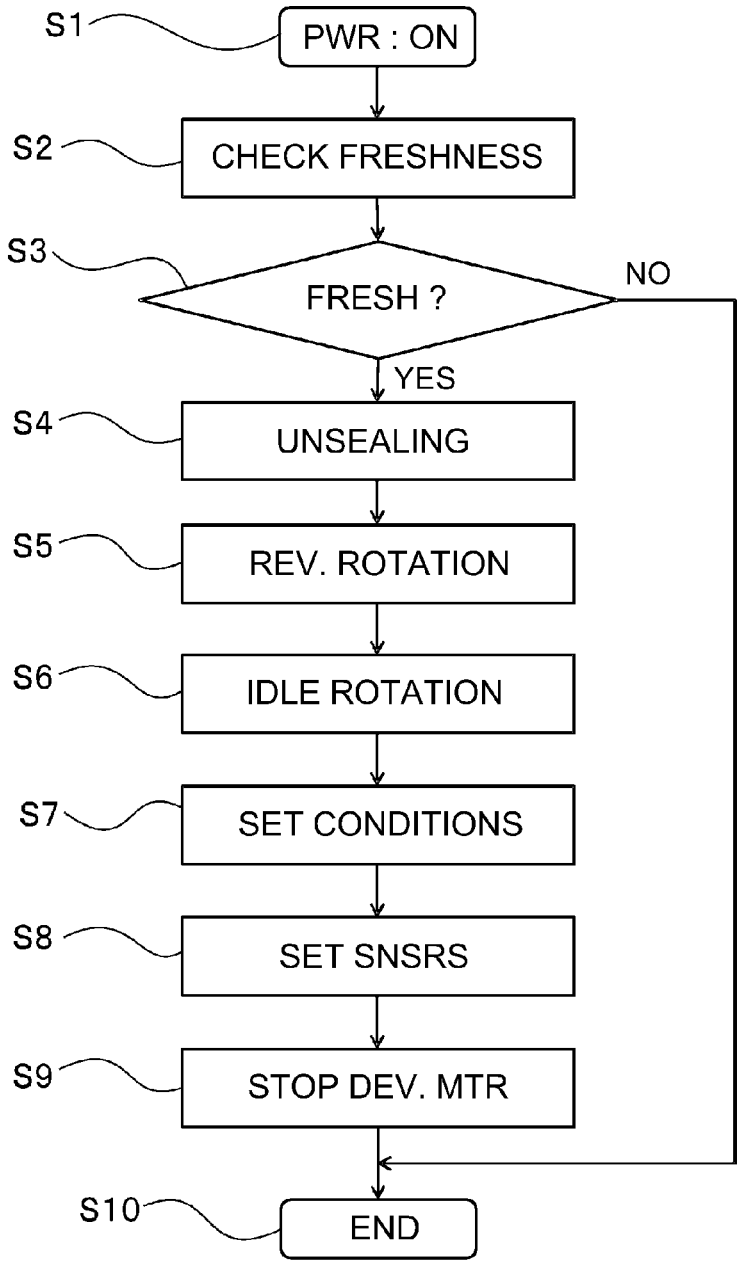
FIG. 5 is a flowchart of the initialization sequence for the developing device in the first embodiment.

Next, referring to FIGS. 4 and 5, the initialization operation which is carried out as the developing device 1 is installed into the main assembly of the image forming apparatus 6 is described. FIG. 4 is a block diagram of a part of the control system of the image forming apparatus 6 in this embodiment, which is related to the initialization operation. It shows the structure of the part. FIG. 5 is a flowchart of the initialization operation sequence which is carried out as the developing device 1 is installed into the main assembly of the image forming apparatus 6.

Referring to FIG. 4, the image forming apparatus 6 has a CPU 60 (Central Processing Unit) which is a controlling means. The CPU 60 is in connection to a RAM (Random Access Memory), which is used as an operational memory (storing means). Further, the CPU 60 is in connection to a ROM 62 (Read Only Memory) in which the programs to be carried out by the CPU 60, and various data, are stored.

Further, the CPU 60 is in connection to various sensors with which each of the developing devices 1 which are different in the color of the toner they use, is provided. Further, the CPU 60 is in connection to an I/O (Input/Output) device 63 for causing each of the development motors 66 or the like, as a driving force source for driving the developing device 1, to operate. Further, the CPU 60 is in connection to the sensor 64, as a detecting means, which detects whether a developing device 1 is brand-new or used one as the developing device 1 is installed into the main assembly of the image forming apparatus 6.

Ordinarily, as the developing device 1 and/or a drum unit such as the photosensitive drum 28, which are in the image forming apparatus 6, is replaced with a brand-new one, an operation for initializing the developing device 1 is carried out. Referring to FIG. 5, in an initialization operation, as the electrical power source of the image forming apparatus 6 is turned on in Step S1, whether the developing device 1 in the main assembly of the image forming apparatus 6 is brand-new or used one is detected by the developing device status sensor 64, in Step S2.

Then, in Step S3, the CPU 60 determines whether the developing device 1 in the main assembly of the image forming apparatus 6 is brand-new or used one, based on the detection signals from the status sensor 64.

There are various methods for detecting whether or not the developing device 1 in the main assembly of the image forming apparatus 6 is brand-new or a used one. However, it does not matter which method is used. The developing device 1 in this embodiment is provided with a fuse. Thus, as one of the terminals of the substrate of the fuse comes into contact with the contact point of the main assembly of the image forming apparatus 6, whether the developing device 1 in the main assembly of the image forming apparatus 6 is a brand-new one or used one is detected by the status sensor 64.

If the developing device 1 in the main assembly of the image forming apparatus 6 is a brand-new one, a preset amount of electrical current flows to the fuse, with which the developing device 1 is provided. Consequently, the fuse is blown. Thus, it can be determined by the status sensor 64 that the developing device 1 in the main assembly of the image forming apparatus 6 is a brand-new one.

If the developing device 1 in the main assembly of the image forming apparatus 6 is a used one, its fuse will have been blown, and therefore, electrical current does not flow. Thus, it is possible for the status sensor 64 to determine that the developing device 1 is a used one.

If it is determined in Step S3 that the developing device 1 in the main assembly of the image forming apparatus 6 is a brand-new one, the CPU 60 proceeds to Step S4. In the case of the developing device 1 in this embodiment, the sealing sheet 51 is to be manually removed by a user or a service person. Thus, a message or sign which prompts a user or a service person to remove the sealing sheet 51 is displayed on a display panel 65, as a displaying means, with which the main assembly of the image forming apparatus 6 is provided.

Thereafter, the sealing sheet 51 is removed by a user or a service person. Even if the image forming apparatus 6 (developing device 1) is structured so that the sealing sheet 51 is automatically removed, the timing with which the sealing sheet 51 is removed is the same as the above-described one.

After the removal of the sealing sheet 51 (unsealing of storage chamber 19), driving of the development motor 66 is started in Step S5. At first, the development motor 66 is driven (reversely driven) in the opposite direction from the normal direction for development, for a short length of time. In this embodiment, the development motor 66 is driven in the opposite direction from the normal direction (forward direction) for development, for three seconds.

As the sealing sheet 51 is removed, the initial developer 10*i* falls from the storage chamber 19 into the bottom portion of the development chamber 11 due to its own weight, as shown in part (b) of FIG. 6. Then, a part of the fallen initial developer 10*i* in the development chamber 11 is conveyed in the direction indicated by an arrow mark c in part (c) of FIG. 6, by the reversal rotation of the first conveyance screw 13, which is caused by the reversal rotation of the development motor 66, into the stirring chamber 12, through the developer passage 16, that is, the opening between the development chamber 11 and stirring chamber 12.

As a part of the initial developer 10*i* is moved into the stirring chamber 12, it is fed in the direction indicated by the arrow mark c in part (c) of FIG. 6, by the reverse rotation of the second conveyance screw 14.

Thereafter, the development motor 66 is idled in the normal direction for development (forward direction), for a preset length of time, in Step S6. In this embodiment, the length of time the development motor 66 is to be idled in the normal direction for development (forward direction) was set to 120 seconds.

While the development motor 66 is idled for the preset length of time, the initial developer 10*i*, which has just fallen into the development chamber 11, is circulated through the entirety of the developer container 2. Thus, the toner in the initial developer 10*i* is increased in the amount of electrical charge, by the rotation of the spiral blades 13*b* and 14*b* of the first and second conveyance screws 13 and 14, respectively, while the initial developer 10*i* in the development chamber 11 is gradually leveled (body of initial developer 10*i* in the development chamber 11 is reduced in the height of its ridge).

In this embodiment, the sealing sheet 51 is removed at the beginning of the initialization of the developing device 1, whereby the initial developer 10*i* which was kept sealed in the storage chamber 19 by the sealing sheet 51 is allowed to fall into the upstream side (right side in part (b) of FIG. 6) of the discharge opening 40 of the development chamber 11 in terms of the normal developer conveyance direction for development.

Thereafter, the first and second conveyance screws 13 and 14 are rotated in the opposite direction (reversely rotated) from the normal direction (forward direction indicated by arrow marks d and e, respectively, in FIG. 2) for development. Then, they are rotated forward, that is, in the normal direction (indicated by arrow marks d and e, respectively, in FIG. 2) to initialize the developing device 1.

After the development motor 66 is idly rotated in the forward direction, that is, in the normal direction for development, image formation conditions are set in Step S7. Here, "image formation conditions" include the condition regarding the electrical charge to be given to the peripheral surface of the photosensitive drum 28 by the charge roller 21 as charge bias voltage is applied to the charge roller 21 from an unshown charge bias power source. Further, they include the condition regarding the development bias voltage to be applied to the development sleeve 3 by an unshown development bias power source. Further, they include the condition regarding the primary transfer voltage to be applied to the primary transfer roller 23 by an unshown primary transfer bias power source. Further, they include various other conditions provided by a tone adjustment tables for each color component, and the like tables.

Then, multiple toner test patterns are formed on the peripheral surface of the photosensitive drum 28 under the preset image formation conditions, with the amount of exposure set at various levels (low density and intermediate density). Then, conditions for various sensors are set in Step S8. Then, output values are estimated based on the density information detected by a density sensor 29 disposed adjacent to the intermediary transfer belt 24. Here, "output values" include the optimal value for the charge voltage, optimal value for the development bias voltage, optimal value for the primary transfer voltage, and values in the toner adjustment table.

After the setting of the conditions for these sensors, the driving of the development motor 66 is ended in Step S9, and the initialization operation is ended (Step S10).

<Developer Level During Initialization Operation>

Next, referring to FIGS. 6 and 7, changes which occur to the level of the surface 10*s* of the initial developer 10*i* in the development chamber 11, which is two-component developer, during the initialization operation which is carried out as the developing device 1 is installed into the main assembly of the image forming apparatus 6, is described. Referring to part (a) of FIG. 6, when the developing device 1 is brand-new, it is provided with the initial developer 10*i* (initial supply of developer) which remains sealed in the storage chamber 19, which makes up the top portion of the development chamber 11, by the sealing sheet 51.

A user or service person is to grasp the tab attached to the outward end of the folded-back portion 51*b* of the sealing sheet 51 in a manner to outwardly protrude from the developing device 1, and pull the sealing sheet 51 in the direction indicated by an arrow mark a in part (a) of FIG. 6. As the sealing sheet 51 is pulled, the adhesive margin portion 51*a* of the sealing sheet 51 is separated from the bottom surface of the rib 52*a* and that of the rib 52*b*. Consequently, the opening 19*a* of the storage chamber 19 becomes exposed. Thus, the initial developer 10*i* which was kept sealed in the storage chamber 19 is made to fall into the bottom portion of the development chamber 11 through the opening 19*a* by its own weight, as shown in part (b) of FIG. 6.

Referring to part (b) of FIG. 6, immediately after the initial developer 10*i* fell into the development chamber 11 after the removal of the sealing sheet 51, it remains piled up in the shape of a mountain to a certain height in the development chamber 11. That is, the peak portion of the body of initial developer 10*i* in the development chamber 11 reaches higher than the discharge opening 40.

Referring to part (b) of FIG. 6, in this embodiment, it is the development chamber 11 that is provided with the discharge opening 40. Therefore, if the development motor 66 is rotated in the normal direction (forward) for development to rotate the first conveyance screw 13 in the normal direction (forward) while the body of the initial developer 10*i* in the development chamber 11 remains in the state shown in part (b) of FIG. 6, it is possible that after the initial developer 10*i* is conveyed downstream in terms of the normal developer conveyance direction for development, it will be discharged unused (will be wasted) by a substantial amount through the discharge opening 40.

In this embodiment, therefore, before the initialization operation is started after the installation of the developing device 1 into the main assembly of the image forming apparatus 6, the development motor 66 is rotated in the opposite direction from the normal direction (forward) for development to reversely rotate the first and second conveyance screws 13 and 14.

Referring to part (c) of FIG. 6, as the first and second conveyance screws 13 and 14 are reversely rotated, the initial developer 10*i* in the development chamber 11 is conveyed in the direction indicated by an arrow mark b in part (c) of FIG. 6, that is, away from the discharge opening 40, and is sent little by little into the stirring chamber 12 through the developer passage 16, that is, the opening between the two chambers 11 and 12.

In this embodiment, the developing device 1 is structured so that the initial developer 10*i* (initial supply of developer 10) is kept sealed (stored) on the upstream side (right side in part (b) of FIG. 6) of the discharge opening 40 in terms of the direction (right-to-left direction) in which the developer is conveyed when the first conveyance screw 13 is rotated in the normal direction (forward) for development. Thus, it is assured that while the first conveyance screw 13 is reversely rotated during the initialization operation, there is no initial developer 10*i* in the adjacencies of the discharge opening 40.

Referring to part (c) of FIG. 6, as the first and second conveyance screws 13 and 14 are reversely rotated, the initial developer 10*i* in the development chamber 11 is conveyed in the direction indicated by the arrow mark b in part (c) of FIG. 6 by the reverse rotation of the first conveyance screw 13, is guided into the stirring chamber 12 through the developer passage 16, and is conveyed in the stirring chamber 12 in the direction indicated by the arrow mark c in part (c) of FIG. 6 by the reverse rotation of the second conveyance screw 14.

Thus, the amount of the initial developer 10*i* in the development chamber 11 reduces to as small as roughly half the initial amount as shown in part (a) of FIG. 7. Further, in the development chamber 11, the body of the initial developer 10*i* reduces in volume, while being stirred by the reverse rotation of the first conveyance screw 13 and gradually leveled. Consequently, the surface 10*s* (ridge) of the body of initial developer 10*i* becomes lower than the level at which it was, as shown in part (a) of FIG. 6, before the first and second conveyance screws 13 and 14 begin to be reversely rotated.

Thereafter, the development motor 66 is switched in rotational direction so that it rotates in the normal direction for developer to idly rotate the first and second conveyance screws 13 and 14 in their normal direction for development, as shown in part (a) of FIG. 7. By the time when the first and second conveyance screws 13 and 14 begin to be idly rotated in the normal direction for development, the initial developer 10*i* in the development chamber 11 will have reduced in amount, and also, the portion of the initial developer 10*i*, which will have remained in the development chamber 11, will have been roughly leveled by being conveyed by the first conveyance screw 13.

Therefore, the body of initial developer 10*i* in the development chamber 11 is relatively low in height in the adjacencies of the discharge opening 40. Therefore, it is possible to prevent the problem that as the first conveyance screw 13 begins to be rotated in the normal direction for development, a part of the initial developer 10*i* in the development chamber 11 is wastefully discharged through the discharge opening 40 before it is used for development.

Referring to part (b) of FIG. 7, as the first and second conveyance screws 13 and 14 are idly rotated in the normal (forward) direction for development, the initial developer 10*i*, which is two-component developer, is circularly conveyed throughout the developer container 2 of the developing device 1 by way of the development chamber 11 and stirring chamber 12. Thus, the body of the initial developer 10*i* in the development chamber 11 is roughly leveled, being thereby reduced in the height of its surface 10*s* (ridge). This concludes the initialization operation.

In this embodiment, 300 g of developer 10 was kept sealed as the initial developer 10*i* (initial supply of developer 10) in the storage chamber 19. During the initialization operation, 5 g of unused initial developer 10*i* was discharged through the discharge opening 40.

In comparison, in a case where the first conveyance screw 13 is not rotated in reverse at the beginning of the initialization operation, unlike in this embodiment, 30 g of unused initial developer 10*i* was discharged through the discharge opening 40 when the amount by which the initial developer 10*i* was kept sealed in the storage chamber 19 was 300 g.

Thus, it was proved that this embodiment can reduce the amount by which unused initial developer 10*i* is wastefully discharged through the discharge opening 40 during the initialization operation.

In this embodiment, the length of time the first and second conveyance screws 13 and 14 are to be reversely rotated during the initialization operation was set to 3 seconds. However, the length of time the first and second conveyance screws 13 and 14 are to be reversely rotated during the initialization operation is optional.

Referring to part (b) of FIG. 6, as the sealing sheet 51 is peeled away, the initial developer 10*i* (initial supply of developer 10) kept sealed in the storage chamber 19 falls into the bottom side of the development chamber 11. Then, it is started to reversely rotate the first and second conveyance screws 13 and 14 as shown in part (c) of FIG. 6. Thus, no less than roughly half the initial developer 10*i* in the development chamber 11 is conveyed in the clockwise direction in part (c) of FIG. 6 (indicated by arrow marks b and c), being thereby moved into the stirring chamber 12. The length of time the first and second conveyance screws 13 and 14 are to be reversely rotated is desired to be long enough to move no less than roughly half the initial developer 10*i* in the development chamber 11, into the stirring chamber 12.

In this embodiment, the pitch P of each of the spiral blade 13*b* of the first conveyance screw 13 and the spiral blade 14*b* of the second conveyance screw 14 was set to 20 mm. Further, the number R of revolution (rotational speed) of each of the first and second conveyance screws 13 and 14 was set to 400 rpm (rotation per minute).

If it is assumed that the conveyance efficiency α of the first and second conveyance screws 13 and 14 is 100%, the initial developer 10*i* is made to advance by 133 mm (=20 [mm]×400 [rotation/min]/60 [sec]) per second by the first and second conveyance screws 13 and 14.

<Conveyance Efficiency>

Here, "R" stands for the number of rotations of the first and second conveyance screws 13 and 14, and "α" stands for the efficiency with which the first and second conveyance screws 13 and 14 can convey the initial developer 10*i*. Further, "P" stands for the pitch of each of the spiral blade 13*b* of the first conveyance screw 13 and the spiral blade 14*b* of the second conveyance screw 14. Thus, the amount by which the initial developer 10*i* is conveyed in the clockwise direction (indicated by arrow marks b and c in part (c) of FIG. 6) by the first and second conveyance screws 13 and 14 can be expressed by the following mathematical equation.

$$A=R\times\alpha\times P \quad [1]$$

Therefore, the amount A by which the initial developer 10*i* is conveyed by the rotation of the first and second conveyance screws 13 and 14 is measured. As the values for the number R of rotations of the first and second conveyance screws 13 and 14, and the value for the pitch P (20 mm) of the spiral blade 13*b* of the first conveyance screw 13 and the value for the pitch P of the spiral blade 14*b* of the second conveyance screw 14, preset values are used.

Thus, the efficiency α with which the initial developer 10*i* is conveyed by the first and second conveyance screws 13 and 14 can be obtained. By the way, the conveyance efficiency α is affected by the properties of the initial developer 10*i*, material for the first and second conveyance screws 13 and 14, and the like factors.

That is, under the most idealistic condition, that is, when the efficiency α with which the initial developer 10*i* is conveyed by the first and second conveyance screws 13 and 14 is 100%, the initial developer 10*i* is made to advance 133 mm per second, by the rotation of the first and second conveyance screws 13 and 14.

In this embodiment, the length (distance between two developer passages 16 and 17, with which the lengthwise end portions of the development chamber 11 were provided, one for one) of the first conveyance screw 13 in the development chamber 11 was 350 mm in terms of the direction (left-to-right direction in part (a) of FIG. 6) which is parallel to the rotational axis 13*a* of the first conveyance screw 13.

Thus, as the first conveyance screw 13 was reversely rotated, roughly half the initial developer 10*i* in the development chamber 11, which is equivalent to roughly half (175 mm=350 [mm]/2]) the length of the first conveyance screw 13, was conveyed in the direction indicated by the arrow mark b, by the first conveyance screw 13. The length of time it took for roughly half the initial developer 10*i* to reach the developer passage 16 was roughly 1.3 seconds (=175 mm/133 [mm/sec]).

Therefore, it takes at least 1.3 seconds for roughly half the initial developer 10*i* in the development chamber 11 to be moved into the stirring chamber 12 by the reverse rotation of the first and second conveyance screws 13 and 14. When the length of time necessary for half the initial developer 10*i* in the development chamber 11 to move into the stirring chamber 12 was calculated with the use of the mathematical equation given above, the efficiency α with which the initial developer 10*i* is conveyed by the first and second conveyance screws 13 and 14 was assumed to be 100%.

In reality, however, the conveyance efficiency α is less than 100% in most cases. In this embodiment, therefore, the length of time the first and second conveyance screws 13 and 14 have to be reversely rotated to move half the initial developer 10*i* in the development chamber 11 into the stirring chamber 12 through the developer passage 16 was set to 3 seconds.

By the way, if the reverse rotation of the first and second conveyance screws 13 and 14 is continued longer than a certain length of time, a part of the initial developer 10*i* is returned to the development chamber 11 from the stirring chamber 12 through the developer passage 17 after it is moved into the stirring chamber 12 through the developer passage 16 and conveyed through the stirring chamber 12 in the counterclockwise direction indicated in part (b) of FIG. 7. Therefore, rotating the first and second conveyance screws 13 and 14 in the reverse direction longer than a certain length of time is meaningless.

Referring to part (b) of FIG. 7, the developer passage 17 in this embodiment does not have a blade for repelling the initial developer 10*i*. Therefore, if the first and second conveyance screws 13 and 14 are reversely rotated longer than a certain length of time, it is possible that the initial developer 10*i* will be packed into the adjacencies of the left end portion (part (b) of FIG. 7) of the second conveyance screw 14, and solidify.

Therefore, the shorter the length of time the first and second conveyance screws 13 and 14 are reversely rotated, the better. For example, the total distance the initial developer 10*i* is made to circulate once in the developer container 2 through the development chamber 11 and stirring chamber 12 of the developer container 2 is 700 mm. Further, the distance between the developer passages 16 and 17 provided in the lengthwise end portions (left and right end portions), one for one, of the developer container 2 in terms of the lengthwise direction of the developer container 2 is 350 mm (length of one-way trip). Further, the length of two-way trip is 700 mm (=350 mm×2).

The length of time necessary for conveying the initial developer 10*i* by 700 mm which is equal to the distance which the initial developer 10*i* is required to travel to circulate once in the developer container 2 through the development chamber 11 and stirring chamber 12 has only to be set to no more than 5.2 seconds (=700 mm/133 [mm/sec]).

In this embodiment, the first and second conveyance screws 13 and 14 are provided with the spiral blades 13*b* and 14*b*, and spiral return blades 13*c* and 14*c*, respectively, which are at the downstream end in terms of the direction in which the developer 10 is conveyed as the first and second conveyance screws 13 and 14 are rotated in the normal direction for development. The spiral return blades 13*c* and 14*c* are wound in the opposite direction from the spiral blades 13*b* and 14*b*, respectively. "Downstream end in terms of the direction in which the developer 10 is conveyed as the first and second conveyance screws 13 and 14 are rotated in the normal direction" means the left end of the first conveyance screw 13 shown in part (a) of FIG. 6, and the right end of the second conveyance screw 14 shown in part (a) of FIG. 6, respectively.

In terms of the normal direction in which the developer 10 is conveyed by the first and second conveyance screws 13 and 14, the downstream end portion of the first conveyance screw 13 and the downstream end portion of the second conveyance screw 14 are provided with the return blades 13*c* and 14*c*, respectively. Thus, as the first and second conveyance screws 13 and 14 are rotated in the normal direction for development, the developer 10 is conveyed downstream by the spiral blades 13*b* and 14*b*. Then, as the developer 10 reaches the downstream end portion, it is repelled upstream, that is, in the direction to be moved away from the downstream end portion, by the return blade 13*c* and 14*c*.

Therefore, the developer 10 (initial developer 10*i*) is prevented from entering the adjacencies of the downstream end portion of the first conveyance screw 13 and the adjacencies of the downstream end portion of the second conveyance screw 14. Therefore, it does not occur that the initial developer 10*i* enters the adjacencies of the downstream end portion of the first conveyance screw 13 and those of the second conveyance screw 14, and is packed into a solid mass.

Referring to part (c) of FIG. 6, in this embodiment, the first and second conveyance screws 13 and 14 are reversely rotated in the initialization operation. As the first and second conveyance screws 13 and 14 are reversely rotated, the initial developer 10*i* is subjected to the force generated by the return blades 13*c* and 14*c* in the direction to push the initial developer 10*i* toward the downstream end of the first conveyance screw 13, and the downstream end of the second conveyance screw 14, respectively.

In this embodiment, however, the development chamber 11 is on top of the stirring chamber 12. Therefore, as the first and second conveyance screws 13 and 14 are reversely rotated, the following occurs. Referring to part (c) of FIG. 6, it does not occur that as the initial developer 10*i* is conveyed to the developer passage 16 by the reverse rotation of the first conveyance screw 13, it reaches the right end of the development chamber 11 in part (c) of FIG. 6. That is, as the initial developer 10*i* nears the right end of the development chamber 11, it falls into the stirring chamber 12 through the developer passage 16. Therefore, it does not occur that the initial developer 10*i* enters the adjacencies of the right end portion of the rotational axle 13*a* of the first conveyance screw 13.

Further, referring to part (c) of FIG. 6, where in the stirring chamber 12 the initial developer 10*i* falls through the developer passage 16 of the development chamber 11 after it is conveyed to the developer passage 16 is as follows. The developing device 1 is structured so that in terms of the vertical direction, the return blade 14*c* of the second conveyance screw 14 does not overlap with where in the development chamber 11 the initial developer 10*i* falls.

Therefore, it does not occur that as the second conveyance screw 14 is reversely rotated, the initial developer 10*i* is conveyed to the right side of the developer passage 16, shown in part (c) of FIG. 6, of the stirring chamber 12 by the return blade 14*c* of the second conveyance screw 14, enters the adjacencies of the right end of the second conveyance screw 14, and is compacted into a solid mass.

Referring to part (c) of FIG. 6, on the other hand, the left end portion of the second conveyance screw 14, which faces the developer passage 17 of the stirring chamber 12, is not provided with a return blade. Therefore, as the second conveyance screw 14 is reversely rotated, the initial developer 10*i* is conveyed to the left end (part (c) of FIG. 6) of the second conveyance screw 14 by the spiral blade 14*b* of the second conveyance screw 14.

Therefore, in a case where the development chamber 11 is located on top of the stirring chamber 12 as in this embodiment, all that needs to be taken into consideration is that it is only the adjacencies of the left end portion (part (c) of FIG. 6) of the second conveyance screw 14 that the initial developer 10*i* enters through the developer passage 17 of the stirring chamber 12.

By the way, it is not mandatory that the developing device 1 is structured so that the development chamber 11 is located straight above the stirring chamber 12. That is, all that is necessary is that the developing device 1 is structured so that as the initial developer 10*i* is conveyed toward the lengthwise end of the development chamber 11, it falls into the stirring chamber 12 before it reaches the lengthwise end of the development chamber 11. In such a case, as long as the angle of the surface (bottom surface of the development chamber 11) along which the initial developer 10*i* is conveyed, relative to the horizontal direction, is greater than the angle of repose of the initial developer 10*i* in the development chamber 11, the initial developer 10*i* in the development chamber 11 will slide down into the stirring chamber 12.

<Angle of Repose>

Next, referring to FIG. 8, a method for measuring the angle θ of repose of the developer 10 is described, which is as follows. Referring to FIG. 8, the developer 10 is poured into a container 20. Then, the container 20 is horizontally shaken to allow the developer 10 in the container 20 to free-fall onto a measurement plate 30 through the opening 20*a* of the container 20 in such a manner that the developer 10 piles up on the measurement plate 30 in the form of a mountain.

Then, the measurement plate 30 on which the developer 10 is borne is slowly tilted relative to the horizontal direction until the body of developer 10 begins to slide down. Then, the angle between the measurement plate 30 and the horizontal direction is measured when the developer particles in the piles (mountain) of the developer 10 on the measurement plate 30 begin to slide down along the surface of the pile (mountain). The angle of the measurement plate 30 obtained with the use of the above-described method is equal to the angle θ of repose of the developer 10, shown in FIG. 8. The angle θ of repose of the developer 10 is not affected by the amount by which the developer 10 is allowed to free-fall onto the measurement plate 30. However, in order to make it easier to catch the exact moment when the developer particles in the pile (mountain) of developer 10 on the measurement plate 30 begins to slide downward along the surface of the pile (mountain) of the developer 10 as the measurement plate 30 is slowly tilted, 10 g of the developer 10 was placed on the measurement plate 30.

By the way, as the angle θ of repose of the developer 10 is measured for the first time, the top surface of the measurement plate 30 is covered with a thin layer of developer 10. Therefore, the value of the angle θ of repose of the developer 10 obtained by the second try, is substantially different from that obtained by the first try. In this embodiment, therefore, the value of the angle θ of repose of the developer 10 obtained by the second try or thereafter was used as the angle θ of repose of the developer 10.

The initial developer 10*i* used in this embodiment was such developer 10 that had been kept sealed in the storage chamber 19 of the developing device 1 in an ambience which was 10 g/m$^3$ in absolute amount of moisture, and in which the angle θ of repose of the initial developer 10*i* was 22°. By the way, "absolute amount of moisture" means the amount (g) of water vapor in 1 m3 of air space saturated with water vapor.

It is only the first and second conveyance screws 13 and 14 that have to be idly rotated at the beginning of the initialization operation. If the development sleeve 3 shown in FIG. 2 is reversely rotated, the developer 10 borne on the peripheral surface of the development sleeve 3 is conveyed without being regulated by the regulation blade 5, making it possible for the developer 10 to be packed, and remain stuck, between the development sleeve 3 and photosensitive drum 28 and/or between the development sleeve 3 and regulation blade 5.

In this embodiment, the developing device 1 is structured so that the development motor 66 was used as the driving force source for rotationally driving the development sleeve 3, first conveyance screw 13 and second conveyance screw 14.

Therefore, a one-way clutch 67 (FIG. 4) was placed between the development motor 66 and the driving force transmission gear attached to one of the lengthwise ends of the rotational axle of the development sleeve 3. The one-way clutch is such a clutch that when the development motor 66 is rotated in the normal direction for development, it engages the development motor 66 with the unshown driving force transmission gear attached to the lengthwise end of the rotational axle of the detecting section 3 to transmit the driving force from the development motor 66 to the development sleeve 3.

On the other hand, during the initialization of the developing device 1, the development motor 66 is reversely rotates. However, the rotational driving force from the development motor 66 is not transmitted to the development sleeve 3, because there is the one-way clutch 67 between the unshown driving force transmission gear attached to one of the lengthwise ends of the rotational axle of the development sleeve 3, and the development motor 66. Therefore, the development sleeve 3 is not rotated during the initialization of the developing device 1.

Further, the driving force transmission gear attached to one of the lengthwise ends of the rotational axle of the first conveyance screw 13, and the driving force transmission gear attached to one of the lengthwise ends of the rotational axle of the second conveyance screw 14, are directly engaged with the development motor 66, that is, without the placement of the one-way clutch 67 between the rotational axle and driving force transmission gear. Thus, when the development motor 66 is rotated in the same direction as the normal direction for development, the development sleeve 3 rotates with the first and second conveyance screws 13 and 14. On the other hand, when the development motor 66 is reversely driven during the initialization of the developing device 1, only the first and second conveyance screws 13 and 14 rotate, whereas the development sleeve 3 does not rotate.

In this embodiment, the driving force source for the development sleeve 3, and the driving force source for the first and second conveyance screws 13 and 14, are the same one, which is the development motor 66. Further, there is provided the one-way clutch 67 in the power train between the development sleeve 3 and development motor 66.

During the initialization of the developing device 1, the first and second conveyance screws 13 and 14 are rotated in the opposite direction from the direction in which they are rotated for actual development. However, the development sleeve 3 does not rotate in the opposite direction from the direction in which it rotates for actual development, because of the presence of the one-way clutch 67 in the power train between the development motor 66 and development sleeve 3.

In a case where the developing device 1 is structured so that the driving force source (motor) for the development sleeve 3 is different from the driving force (motor) for the first and second conveyance screws 13 and 14, the developing device 1 is driven in the following manner. During the initialization of the developing device 1, the first and second conveyance screws 13 and 14 are rotated in the opposite direction (reversely rotated) from the normal direction for development by the unshown first driving force source (first motor).

Meanwhile, the development sleeve 3 is not rotated by the unshown second driving force source (second motor) in the opposite direction (reversely rotated) from the normal direction for development.

That is, the developing device 1 may be structured so that while the first and second conveyance screws 13 and 14 are reversely rotated for the initialization of the developing device 1, the second motor, which is for the development sleeve 3, is kept turned off, and only the first motor, which is for the first and second conveyance screws 13 and 14, is reversely driven.

In this embodiment, the developing device 1 is structured so that when the development motor 66 reversely rotates during the initialization of the developing device 1, the development sleeve 3 is not rotationally driven. In a case where the storage chamber 19 in which the initial developer 10*i*, or the initial supply of developer 10, is kept sealed, is located is the top portion of the development chamber 11 as in this embodiment, there is no developer 10 in the stirring chamber 12 when the first conveyance screw 13 begins to be reversely rotated.

Therefore, it does not occur that as soon as the first conveyance screw 13 begins to be reversely rotated, the developer 10 is supplied to the peripheral surface of the development sleeve 3. Therefore, even if the development sleeve 3 is reversely rotated, there is no harmful effect, unless the first conveyance screw 13 is reversely rotated for a substantial length of time.

The length of time the first and second conveyance screws 13 and 14 are reversely rotated during the initialization of the developing device 1 is as follows. As long as it is kept shorter than the length of time (5.2 seconds according to forgoing calculation) necessary for the developer 10 to circulate once in the clockwise direction in part (c) of FIG. 6, through the development chamber 11 and stirring chamber 12, there is no substantial amount of ill effect.

However, it is possible that there will be a small amount of ill effect. Thus, whether to drive the development sleeve 3 or not when the first and second conveyance screws 13 and 14 are reversely rotated may be determined according to the cost, life expectancy, specifications, etc., of the developing device 1.

According to this embodiment, the initial developer 10*i* (initial supply of developer 10) is kept sealed in the storage chamber 19, which is the top portion of the development chamber 11 of the developing device 1, with the use of the sealing sheet 51, which is to be removed to unseal the storage chamber 19 at the beginning of the initialization of the developing device 1. Thus, it is possible that as the sealing sheet 51 is removed and the initial developer 10*i* falls into the development chamber 11, certain portions of the surface 10*s* (ridge) of the initial developer 10*i* will become higher than the discharge opening 40.

In this embodiment, however, the ordinary (conventional) initialization operation is carried out after the first and second conveyance screws 13 and 14 are reversely rotated. Therefore, it is possible to prevent the initial developer 10*i* from being excessively discharged through the discharge opening 40.

Embodiment 2

Next, referring to FIGS. 9 and 10, the image forming apparatus 6 in the second embodiment of the present invention is described about its structure. By the way, the components, portions thereof, etc., of the image forming apparatus in this embodiment, which are the same in structure as the counterparts in the first embodiment are given the same referential codes as those given to the counterparts, or the same names with different referential codes, as those given to the counterparts, and are not described here.

Referring to FIG. 2, in the above-described first embodiment, the developing device 1 was of the so-called vertical-stir type, in which the development chamber 11 is located directly on top of the stirring chamber 12. In this embodiment, the developing device 1 is of the so-called horizontal-stir type, in which the development chamber 11 and stirring chamber 12 are disposed side by side, as shown in FIG. 9.

Further, in the first embodiment, the developing device 1 is provided with the storage chamber 19, which is the top portion of the development chamber 11 in which the developer 10 is supplied to the development sleeve 3, as shown in FIG. 2. The developing device 1 in this embodiment is an example of developing device 1 in which the storage chamber 19 in which the initial developer 10*i* is stored is made as the top portion of the stirring chamber 12, as shown in FIG. 9.

Referring to FIG. 9, also in this embodiment, the developing device 1 is provided with the discharge opening 40 for discharging a part of the developer 10 in the developer container 2. More specifically, the discharge opening 40 is a part of the stirring chamber 12, the top portion of which is the storage chamber 19 in which the initial developer 10*i* (initial supply of developer 10) is kept sealed by the sealing sheet 51 as a sealing member. Further, the discharge opening 40 in this embodiment is located on the same side as the one in the first embodiment.

In terms of the positioning of the storage chamber 19 in which the initial developer 10*i* is kept sealed, relative to the discharge opening 40, this embodiment is the same as the first embodiment.

Also in this embodiment, the developer container 2 is provided with an unshown replenishment opening through which the developer container 2 is replenished with replenishment two-component developer 10*r* from the hopper 31 as a replenishing means for replenishing the developer container 2 with the replenishment two-component developer. The developing device 1 is structured so that the discharge opening 40 is located on the upstream side (right side in FIG. 10) of the replenishment opening in terms of the normal direction in which developer is conveyed for development. Thus, it does not occur that as soon as the developer container 2 is replenished with a fresh supply of replenishment two-component developer 10*r* through the unshown replenishment opening, the fresh supply of replenishment two-component developer is discharged through the discharge opening 40.

Also in this embodiment, the sealing sheet 51 which kept the initial developer 10*i* in the storage chamber 19, which is the top portion of the stirring chamber 12, and in which the initial developer 10*i* is stored, is peeled away from the storage chamber 19 to unseal the storage chamber 19, during the initialization operation which is carried out immediately after the installation of the developing device 1 into the main assembly of the image forming apparatus 6. As the sealing sheet 51 is removed, the initial developer 10*i* which remained sealed in the storage chamber 19 falls into the stirring chamber 12, on the upstream side of the discharge opening 40 in terms of the normal developer conveyance direction (rightward in FIG. 10) in a developing operation.

Thereafter, the second conveyance screw 14 (conveying member) disposed in the stirring chamber 12, and the first conveyance screw 13 (conveying member) disposed in the development chamber 11, are rotated (reversely rotated) in the opposite direction from the normal direction for development. Then, they are rotated in the normal direction for development (directions indicated by arrow marks e and e, respectively in FIG. 9) to initialize the developing device 1.

As described above, also in this embodiment, as the developing device 1 is installed into the main assembly of the image forming apparatus 6, the first and second conveyance screws 13 and 14 are reversely rotated at the beginning of the initialization of the developing device 1. Thus, it is possible to obtain the same effects as those obtained in the first embodiment.

Referring to FIG. 9, in this embodiment, the developing device 1 is of the so-called horizontal-stir type, in which the development chamber 11 and stirring chamber 12 are disposed side by side. Therefore, the movement of the initial developer 10*i* after it is allowed to fall from the storage chamber 19 into the stirring chamber 12 by the separation of the sealing sheet 51 is as follows. At the beginning of the initialization of the developing device 1, the first and second conveyance screws 13 and 14 are reversely rotated. However, the initial developer 10*i* is not swiftly moved from the stirring chamber 12 into the development chamber 11 by the rotation of the second conveyance screw 14 and first conveyance screw 13, because the movement of the initial developer 10*i* is not assisted by gravity, unlike in the first embodiment.

Therefore, initial developer 10*i* reaches the lengthwise end of the rotational axle 14*a* of the second conveyance screw 14 shown in FIG. 10, soon after the first and second conveyance screws 13 and 14 began to be reversely rotated.

In this embodiment, therefore, the reverse rotation of the first and second conveyance screws 13 and 14 in the initialization operation of the developing device 1 is controlled as follows. That is, the number R (rotational speed) of times the first and second conveyance screws 13 and 14 are rotated per unit length of time during the initialization of the developing device 1 is made smaller in absolute value than the number of time they are rotated in the normal direction for development.

That is, in this embodiment, the speed (first speed) at which the first and second conveyance screws 13 and 14 are rotated in the opposite direction from the normal direction (indicated by arrow marks e and d, respectively) at the beginning of the initialization of the developing device 1 is controlled so that it becomes less than the speed (second speed) at which the first and second conveyance screws 13 and 14 are rotated in the normal direction (indicated by arrow marks e and d, respectively, in FIG. 9) after being reversely rotated.

Therefore, the initial developer 10*i* is prevented from entering into the adjacencies of the lengthwise end portion of the rotational axle 14*a* of the second conveyance screw 14, shown in FIG. 10, soon after the first and second conveyance screws 13 and 14 begin to be reversely rotated.

More concretely, the number R of times (second rotational speed) the first and second conveyance screws 13 and 14 are rotated per unit length of time in the normal direction for development is 400 rpm. In comparison, the number R (first rotational speed) of times the first and second conveyance screws 13 and 14 are reversely rotated per unit length of time during the operation for initializing the developing device 1 was set to 100 rpm.

Therefore, it was possible to prevent the initial developer 10*i* from entering the adjacencies of the lengthwise end of the rotational axle 14*a* of the second conveyance screw 14, shown in FIG. 10, soon after the first and second conveyance screws 13 and 14 begin to be reversely rotated.

By the way, in this embodiment, the driving force source for the development sleeve 3, and the driving force source for the first and second conveyance screws 13 and 14, were the same one. Further, the one-way clutch was not provided. Thus, as the first and second conveyance screws 13 and 14 is reversely driven at the beginning of the operation for initializing the developing device 1, not only do the first and second conveyance screws 13 and 14 reversely rotate, but also, the development sleeve 3 reversely rotates.

Referring to FIG. 9, in this embodiment, however, the developing device 1 is structured so that the magnetic pole N3 (which functions as pickup pole during reverse rotation of development sleeve 3), which functions as one of repel poles when the development sleeve 3 is rotated in the normal direction for development, is positioned as follows. That is, the developing device 1 is structured so that the magnetic pole N3 is positioned higher than the axis 3*a* of the development sleeve 3.

Therefore, it is difficult for the developer 10 to be picked up by the development sleeve 3 when the development sleeve 3 is reversely rotated during the initialization of the developing device 1. Therefore, even though the development sleeve 3 reversely rotates when the first and second conveyance screws 13 and 14 are reversely rotated, the developer 10 is hardly conveyed by the development sleeve 3. Thus, it was unnecessary to provide the developing device 1 with a driving force source dedicated to the development sleeve 3, or the aforementioned one-way clutch. Therefore, it was possible to reduce the image forming apparatus 6 in cost.

According to this embodiment, the sealing sheet 51 for keeping the initial developer 10*i* in the storage chamber 19, which occupies the top portion of the stirring chamber 12 of the developer container 2 of the developing device 1 is peeled away to unseal the storage chamber 19 during the initialization of the developing device 1. As the sealing sheet 51 is peeled away, the initial developer 10*i* falls into the development chamber 11, and piles up in the development chamber 11, sometimes high enough for the developer surface 10*s* to reach higher than the discharge opening 40. However, before the first and second conveyance screws 13 and 14 begin to be rotated in the normal direction for development, they are reversely rotated. Therefore, it is possible to prevent the initial developer 10*i* from being excessively discharged through the discharge opening 40 during the initialization of the developing device 1. Otherwise, the image forming apparatus (developing device) in this embodiment is the same in structure as that in the first embodiment, and can provide the same effects as those provided by the image forming apparatus 6 in the first embodiment.

According to the present invention, it is possible to prevent the problem that as a sealing member for keeping the initial supply of developer sealed in a developing device is removed, the initial supply of developer is excessively discharged through the discharge opening of the developer container of the developing device, even if the initial supply of developer piles up relatively high in the development chamber and/or stirring chamber of the developing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-210299 filed on Oct. 27, 2015, which is hereby incorporated by reference herein in its entirety.

What is claimed is:

1. A developing apparatus for developing an electrostatic latent image formed on an image bearing member, said apparatus comprising:

a developer carrying member configured to carry a developer;

first and second accommodation chambers configured to accommodate the developer and configured to circulate the developer;

first and second communicating portions configured for communication of the developer between said first accommodation chamber and said second accommodation chamber;

a feeding screw provided in said first accommodation chamber and configured to feed the developer from the second communicating portion toward the first communicating portion during an image forming operation;

a supply opening configured to supply the developer into said first accommodation chamber;

a discharge opening provided adjacent to said first communicating portion and configured to permit discharge of the developer from said first accommodation chamber;

a developer accommodation portion configured to accommodate the developer to be supplied to said first accommodation chamber, said developer accommodation portion being sealed by a sealing member;

a controller configured to execute an operation in a mode in which after said developer accommodation portion starts to be unsealed at said sealing member, said feeding screw is initially rotated for a predetermined period from a start of unsealing of the sealing member in a direction opposite to a normal direction in which said feeding screw is rotated during the image forming operation, and after elapse of the predetermined period, said feeding screw is rotated in the normal direction.

2. An apparatus according to claim 1, further comprising a detecting portion for detecting whether or not said developer accommodating portion is a fresh one, wherein said controller determines whether to execute the operation in the mode depending on an output of said detecting portion.

3. An apparatus according to claim 1, wherein said developer accommodating portion is disposed at a position upstream of said discharge opening with respect to a feeding direction in which the developer is fed during the image forming operation.

4. An apparatus according to claim 1, further comprising a driving source configured to drive said developer carrying member and said feeding screw, and a one-way clutch provided between said developer carrying member and said driving source so as not to transmit to said developer carrying member the driving force for rotating said feeding screw in the opposite direction from said driving source.

5. An apparatus according to claim 1, further comprising a first driving source configured to drive said feeding member and a second driving source configured to drive said developer carrying member, wherein when said feeding member is rotated by said first driving source in the opposite direction, said developer carrying member is not rotated by said second driving source in a direction in which said developer carrying member is rotated during the image forming operation.

6. An apparatus according to claim 1, wherein said feeding screw is rotated in the opposite direction in a first rotational speed and is rotated in the normal direction in a second rotational speed, wherein the first rotational speed is lower than the second rotational speed.

7. An apparatus according to claim 1, wherein said controller executes the operation in the mode in response to an operation start signal.

8. An apparatus according to claim 1, wherein said supply opening is disposed at the position downstream of said discharge opening with respect to a feeding direction in which the developer is fed during the image forming operation.

9. An apparatus according to claim 1, wherein said controller rotates said feeding screw for the predetermined time period in the opposite direction to move part of the developer accommodated in said developer accommodation portion into said second developer accommodation chamber through said first communicating portion.

10. An apparatus according to claim 1, wherein said developer accommodation portion is disposed above said feeding screw.

11. An apparatus according to claim 1, further comprising another feeding screw provided in said second accommodation chamber and configured to feed the developer from the first communicating portion toward the second communicating portion during an image forming operation.

12. An apparatus according to claim 1, wherein said supply opening is disposed downstream of said discharge opening with respect to the normal direction.

13. An apparatus according to claim 1, wherein said discharge opening is disposed downstream of said developer accommodation portion and upstream of said first communicating portion with respect to the normal direction.

14. An apparatus according to claim 1, wherein said first accommodation chamber is disposed above said second accommodation chamber.

15. An apparatus according to claim 1, wherein said first accommodation chamber and said second accommodation chamber are juxtaposed with each other, and said first accommodation chamber is more remote from said developer carrying member than said second accommodation chamber.

* * * * *